US007624823B2

(12) United States Patent
Chen

(10) Patent No.: US 7,624,823 B2
(45) Date of Patent: Dec. 1, 2009

(54) ROLLER CONE DRILL BITS WITH OPTIMIZED CUTTING ZONES, LOAD ZONES, STRESS ZONES AND WEAR ZONES FOR INCREASED DRILLING LIFE AND METHODS

(75) Inventor: Shilin Chen, The Woodlands, TX (US)

(73) Assignee: Halliburton Energy Services, Inc., Carrollton, TX (US)

( * ) Notice: Subject to any disclaimer, the term of this patent is extended or adjusted under 35 U.S.C. 154(b) by 0 days.

(21) Appl. No.: 11/875,098

(22) Filed: Oct. 19, 2007

(65) Prior Publication Data

US 2008/0029308 A1 Feb. 7, 2008

Related U.S. Application Data

(60) Division of application No. 11/284,540, filed on Nov. 22, 2005, which is a continuation-in-part of application No. 10/919,990, filed on Aug. 17, 2004, now Pat. No. 7,434,632.

(60) Provisional application No. 60/629,925, filed on Nov. 22, 2004, provisional application No. 60/549,339, filed on Mar. 2, 2004.

(51) Int. Cl.
*E21B 10/50* (2006.01)
*E21B 10/46* (2006.01)

(52) U.S. Cl. ..... 175/374; 175/426; 703/7

(58) Field of Classification Search ..... 175/331, 175/374, 426; 703/1, 2, 6, 7, 10
See application file for complete search history.

(56) References Cited

U.S. PATENT DOCUMENTS

| | | | | |
|---|---|---|---|---|
| 4,343,372 A | | 8/1982 | Kinzer | 175/374 |
| 4,804,051 A | | 2/1989 | Ho | 175/26 |
| 4,889,017 A | | 12/1989 | Fuller et al. | 73/108 A |
| 5,027,913 A | | 7/1991 | Nquyen | 175/336 |
| 5,131,480 A | | 7/1992 | Lockstedt et al. | 175/374 |
| 5,456,141 A | | 10/1995 | Ho | 76/108.2 |
| 5,595,252 A | | 1/1997 | O'Hanlon | 175/57 |
| 5,839,526 A | * | 11/1998 | Cisneros et al. | 175/431 |
| 6,003,623 A | | 12/1999 | Miess | 175/430 |
| 6,029,759 A | | 2/2000 | Sue et al. | 175/374 |

(Continued)

FOREIGN PATENT DOCUMENTS

EP 1006256 6/2000

(Continued)

OTHER PUBLICATIONS

International Search Report, PCT/US2006/030830, 11 pages, Mailing Date Dec. 19, 2006.

(Continued)

*Primary Examiner*—Shane Bomar
(74) *Attorney, Agent, or Firm*—Baker Botts L.L.P.

(57) ABSTRACT

Roller cone drill bits may be formed with cutting elements and cutting structures optimized to increase downhole drilling life of an associated drill bit. The cutting zone, load zone and wear zone of each cutting element may be analyzed by finely meshing each cutting element into many small segments. The number of contacts between each meshed segment and portions of a downhole formation may be determined during discrete drilling time periods. A distribution of sliding velocity for each segment relative to portions of the downhole formation may also be determined during the discrete drilling time periods. Force profiles for each cutting zone may be used to determine associated loading zones. A wear profile for each cutting element may be estimated by combining the associated force profile with the associated distribution of sliding velocity.

20 Claims, 13 Drawing Sheets

U.S. PATENT DOCUMENTS

| | | | | |
|---|---|---|---|---|
| 6,095,264 | A | 8/2000 | Dillard | 175/331 |
| 6,119,797 | A | 9/2000 | Hong et al. | 175/336 |
| 6,176,329 | B1 | 1/2001 | Portwood et al. | 175/341 |
| 6,241,035 | B1 | 6/2001 | Portwood | 175/374 |
| 6,260,635 | B1 | 7/2001 | Crawford | 175/371 |
| 6,269,892 | B1 | 8/2001 | Boulton et al. | 176/61 |
| 6,394,202 | B2 | 5/2002 | Truax et al. | 175/434 |
| 6,412,577 | B1 | 7/2002 | Chen | 175/57 |
| 6,484,826 | B1 | 11/2002 | Anderson et al. | 175/428 |
| 6,499,547 | B2 | 12/2002 | Scott et al. | 175/374 |
| 6,516,293 | B1 * | 2/2003 | Huang et al. | 703/10 |
| 6,581,699 | B1 | 6/2003 | Chen et al. | 175/61 |
| 6,725,953 | B2 | 4/2004 | Truax et al. | 175/434 |
| 6,848,518 | B2 | 2/2005 | Chen et al. | 175/61 |
| 6,856,949 | B2 | 2/2005 | Singh et al. | 703/7 |
| 6,879,947 | B1 | 4/2005 | Glass | 703/10 |
| 7,020,597 | B2 | 3/2006 | Oliver et al. | 703/7 |
| 7,079,996 | B2 | 7/2006 | Stewart et al. | 703/8 |
| 7,147,066 | B2 | 12/2006 | Chen et al. | 175/61 |
| 7,195,078 | B2 * | 3/2007 | Singh et al. | 175/40 |
| 2001/0042642 | A1 | 11/2001 | King | 175/40 |
| 2003/0192721 | A1 * | 10/2003 | Singh et al. | 175/341 |
| 2003/0195733 | A1 * | 10/2003 | Huang et al. | 703/10 |
| 2004/0251053 | A1 * | 12/2004 | McDonough et al. | 175/378 |
| 2006/0032674 | A1 | 2/2006 | Chen et al. | 175/372 |
| 2006/0074616 | A1 | 4/2006 | Chen | 703/10 |

FOREIGN PATENT DOCUMENTS

| | | |
|---|---|---|
| GB | 2186715 | 8/1987 |
| GB | 2300208 | 10/1996 |
| GB | 2367626 | 4/2002 |
| GB | 2384567 | 7/2003 |
| GB | 2400696 | 10/2004 |

OTHER PUBLICATIONS

Menand et al., Classification of PDC Bits According to their Steerability, SPE, 11 pgs, 2003.

International Search Report, PCT/US2006/030803, 11 pgs, Mailing date Dec. 19, 2006.

Hare et al., Design Index: A Systematic Method of PDC Drill-Bit Selection, SPE, 15 pgs, 2000.

Halliburton Revolutionizes PDC Drill Bit Design with the Release of FM3000, 2003 Press Releases, 2 pgs, Aug. 8, 2005.

D Stroud et al., "Development of the Industry's First Slimhole Point-the-Bit Rotary Steerable System," Society of Petroleum Engineers Inc, 4 pgs, 2003.

J.A. Norris, et al., "Development and Successful Application of Unique Steerable PDC Bits," Copyright 1998 IADC/SPE Drilling Conference, 14 pgs, Mar. 3, 1998.

O. Vincke, et al., "Interactive Drilling: The Up-To-Date Drilling Technology," Oil & Gas Science and Technology Rev. IFP, vol. 59, No. 4, pp. 343-356, Jul. 2004.

Halliburton catalogue item entitled: EZ-Pilot (TM) Rotary Steerable System (1 page), Jul. 24, 2006.

Halliburton catalogue item entitled: Geo-Pilot (R) Rotary Steerable System (1 page), Jul. 24, 2006.

Halliburton catalogue item entitled: SlickBore (R) Matched Drilling System (1 page), Jul. 24, 2006.

Maurer, W. C., "*the Perfect-Cleaning Theory of Rotary Drilling*", Journal of Petroleum Technology, SPE, pp. 1270-1274, Nov. 1962.

Ma. D., et al. "*A New Method for Designing Rock Bit*", SPE Proceedings, vol. 22431, XP008058830, 10 pages, Mar. 24, 1992.

Notification of Great Britain Search Report for Application No. GB 0516638.4 (4 pages), Jan. 5, 2006.

Notification of Great Britain Search Report for Application No. GB 0523735.9 (3 pages), Jan. 31, 2006.

Communication from European Patent Office regarding opposition; Application No. 99945376.4-1266/117894 through the Munich office (5 pages), Feb. 15, 2006.

Sutherland et al. "Development & Application of Versatile and Economical 3D Rotary Steering Technology" AADE, Emerging Technologies (pp. 2-16), 2001.

Patent Acts 1977: Error in Search Report, Application No. GB0516638.4, 2 pgs, May 24, 2006.

Decision revoking European Patent No. EP-B-1117894, 16 pgs, May 15, 2006.

Notification of European Search Report for Patent application No. 04025232.5-2315, pages, Apr. 4, 2006.

Notification of European Search Report for Patent application No. 04025234.8-2315, 3 pages, Apr. 4, 2006.

Notification of European Search Report for Patent application No. 04025233.0-2315, 3 pages, 4/11/006.

Notification of European Search Report for Patent Application No. EP 04025560.6-2315 (4 pages), Feb. 24, 2006.

Notification of European Search Report for Patent Application No. EP 04025561.4-2315 (4 pages), Feb. 24, 2006.

Approved Judgment before Ho. Pumfrey, High Court of Justice, Chancery Division, Patents Court, Case HC04C00114, 00689, 00690, (Halliburton v. Smith Internl), Royal Courts of Justice, Strand, London. (84 pages), Feb. 24, 2006.

Notification of European Search Report for Patent Application No. EP 04025562.2-2315 (4 pages), Feb. 24, 2006.

Notification of European Search Report for Patent Application No. EP 04025232.2-2315 (4 pages), Feb. 24, 2006.

Chinese Office Action, Patent App. No. 200510052895.4 (with English translation), 15 pages, Oct. 10, 2008.

Chinese Office Action, Patent App. No. 200510052895.4 (with English translation), 7 pages. May 8, 2009.

Chinese Office Action, Patent App. No. 200510052895.4 (with English translation), 10 pages Aug. 28, 2009.

* cited by examiner

ROLLER CONE DRILL BITS WITH OPTIMIZED CUTTING ZONES, LOAD ZONES, STRESS ZONES AND WEAR ZONES FOR INCREASED DRILLING LIFE AND METHODS

RELATED APPLICATION

This application claims the benefit of U.S. Provisional Patent Application Ser. No. 60/629,925 filed Nov. 22, 2004, entitled Roller Cone Drill Bits with Optimized Cutting Zones, Load Zones, Stress Zones and Wear Zones for Increased Drilling Life and Methods. The content of this application is incorporated herein in it's entirety by this reference.

This application is a divisional application of U.S. patent application Ser. No. 11/284,540 filed on Nov. 22, 2005, entitled Roller Cone Drill Bits with Optimized Cutting Zones, Load Zones, Stress Zones and Wear Zones for Increased Drilling Life and Methods, which is a continuation-in-part application of U.S. patent application Ser. No. 10/919,990 filed Aug. 17, 2004, entitled Roller Cone Drill Bits With Enhanced Drilling Stability and Extended Life Of Associated Bearings And Seals, now U.S. Patent Application Publication No. 2005/0194191 A1 now U.S. Pat. No. 7,434,632, which claims benefit of Provisional Patent Application Ser. No. 60/549,339 filed on Mar. 2, 2004. The contents of these applications are incorporated herein in their entirety by this reference.

TECHNICAL FIELD

The present invention is related to roller cone drill bits used to form wellbores in subterranean formations and more particularly to arrangement and design of cutting elements and cutting structures to enhance drilling performance and extend drilling life of an associated drill bit.

BACKGROUND

A wide variety of roller cone drill bits have previously been used to form wellbores in downhole formations. Such drill bits may also be referred to as "rotary" cone drill bits. Roller cone drill bits frequently include a bit body with three support arms extending therefrom. A respective cone assembly is generally rotatably mounted on each support arm opposite from the bit body. Such drill bits may also be referred to as "rock bits".

Examples of roller cone drill bits satisfactory to form wellbores include roller cone drill bits with only one support arm and one cone, two support arms with a respective cone assembly rotatably mounted on each arm and four or more cones rotatably mounted on an associated bit body. Various types of cutting elements and cutting structures such as compacts, inserts, milled teeth and welded compacts have also been used in association with roller cone drill bits.

Cutting elements and cutting structures associated with roller cone drill bits typically form a wellbore in a subterranean formation by a combination of shearing and crushing adjacent portions of the formation. The shearing motion may also be described as each cutting element scraping portions of the formation during rotation of an associated cone. The crushing motion may also be described as each cutting element penetrating or gouging portions of the formation during rotation of an associated cone.

Roller cone drill bits having cutting structures formed by milling steel teeth are often used for drilling soft formations and some harder formations. Roller cone drill bits having cutting elements and cutting structures formed from a plurality of hard metal inserts or compacts are often used for drilling both medium and hard formations. Roller cone drill bits are generally more efficient in removing a given volume of formation by shearing or scraping as compared with crushing or penetration of the same formation. It is generally well known in the roller cone drill bit industry that drilling performance may be improved by varying the orientation of cutting elements and cutting structures disposed on associated cone assemblies.

SUMMARY OF THE DISCLOSURE

In accordance with teachings of the present disclosure, roller cone drill bits may be provided with cutting elements and cutting structures designed to substantially improve drilling efficiency and increase downhole drilling life. The design of cutting elements and cutting structures may be optimized by determining the location of respective cutting zones, loading zones, stress zones and/or wear zones in accordance with teachings of the present invention. The present invention includes using drilling parameters associated with various downhole environments and various drill bit design parameters to optimize the design of cutting elements, cutting structures, roller cones and associated drill bits.

The location of cutting zones, loading zones, stress zones and wear zones for each cutting element will vary depending on associated drill bit design parameters such as the position of each cutting element in a gage row or inner rows and will vary between roller cone one, two or three. Also, the location of cutting zones, loading zones, stress zones and wear zones for each cutting element will vary depending on associated drilling parameters. The present invention allows optimizing downhole drilling performance of each cutting element, cutting structure, roller cone and associated drill bit by simulating interaction between each cutting element and a downhole formation.

Technical benefits of the present invention include reducing stress levels in cutting elements and cutting structure by determining portions of each cutting element (cutting zone, loading zone, stress zone and wear zones) which are most effected by downhole drilling parameters and modifying the design of the respective cutting element.

Drilling efficiency and downhole drilling life of a roller cone drill bit often depends on the design of associated cutting elements, cutting structures and roller cones. Determining the cutting zone, loading zone, stress zone and wear zone associated with each cutting element and cutting structure in accordance with teachings of the present invention allows optimizing cutting element and cutting structure designs to increase drilling efficiency and downhole drilling life of an associated roller cone drill bit. The present invention may also provide improved directional control and steering ability of a roller cone drill bit during drilling of inclined and horizontal wellbores.

Further technical benefits of the present invention include placing hard materials at optimum locations on exterior portions of each cutting element corresponding with associated cutting zones and loading zones. Hard materials may also be disposed within portions of each cutting element corresponding with associated cutting zones and loading zones. The type of hard materials, the location of the hard materials and the shape or geometry of the hard materials may be modified in accordance with teachings of the present invention based on the respective location of each cutting element on an associated roller cone assembly. The type, location and shape or geometry of the hard materials may also be modified based on other drill bit design parameters. The type of hard materials, the location of the hard materials and the shape or geometry of the hard materials may be modified based on downhole drilling parameters.

The present invention allows reducing stress levels, by determining which portion of a cutting element or cutting structure (core cutting zone) is cutting most of the time during downhole drilling. The present invention includes determining forces distributed over the core cutting zone which may be used to determine an associated core loading zone for the cutting element. Finite element analysis may then be used to determine associated stress zones. The design of the cutting element may then be modified to reduce stress levels. Both residual stress and applied stress may be significantly reduced by designing cutting elements and cutting structures in accordance with teachings of the present invention.

The present invention allows designing drill bits with increased probability that each drill bit when manufactured will meet selected criteria for optimum drilling performance. The present invention may substantially reduce or eliminate extensive field testing of prototype drill bits to confirm actual downhole drilling performance of a new drill bit design.

BRIEF DESCRIPTION OF THE DRAWINGS

A more complete and thorough understanding of the present embodiments and advantages thereof may be acquired by referring to the following description taken in conjunction with the accompanying drawings, in which like reference numbers indicate like features, and wherein.

DETAILED DESCRIPTION OF THE DISCLOSURE

Figure 1:
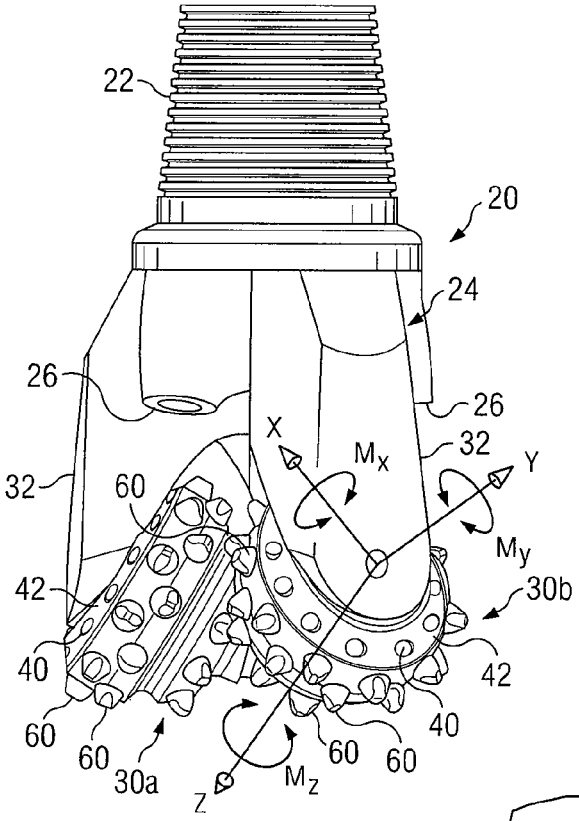
FIG. 1 is a schematic drawing showing an isometric view of one example of a roller cone drill bit incorporating teachings of the present invention.

Preferred embodiments and their advantages are best understood by reference to FIGS. 1-21 wherein like numbers refer to same and like parts.

The terms "cutting element" and "cutting elements" may be used in this application to include various types of compacts, inserts, milled teeth and welded compacts satisfactory for use with roller cone drill bits. The terms "cutting structure" and "cutting structures" may be used in this application to include various combinations and arrangements of cutting elements formed on or attached to one or more cone assemblies of a roller cone drill bit. Teachings of the present invention may be used to design roller cone drill bits having inserts, compacts and/or milled teeth. The present invention may also be used to design roller cone drill bits having cutting elements (not expressly shown) welded to associated cone assemblies.

Some cutting elements formed in accordance with teachings of the present invention may have generally symmetrical configurations with respect to an associated longitudinal axis or geometric axis. For other applications, cutting elements may be formed in accordance with teachings of teachings of the present invention with asymmetric or nonsymmetrical configurations relative to an associated longitudinal axis or geometric axis. Cutting elements and cutting structures formed in accordance with teachings of the present invention may have a wide variety of designs and configurations.

The terms "crest" and "longitudinal crest" may be used in this application to describe portions of a cutting element or cutting structure that makes initial contact with a formation during drilling of a wellbore. The crest of a cutting element will typically engage and disengage the bottom of a wellbore during rotation of a roller cone drill bit and associated cone assembly. The geometric configuration and dimensions of crests may vary substantially depending upon specific design and dimensions of associated cutting elements and cutting structures.

The term "cone profile" may be defined as an outline of the exterior surface of a cone assembly and all cutting elements associated with the cone assembly projected onto a vertical plane passing through an associated cone rotational axis. Cone assemblies associated with roller cone drill bits typically have generally curved, tapered exterior surfaces. The physical size and shape of each cone profile depends upon various factors such as the size of an associated drill bit, cone rotational angle, offset of each cone assembly and size, configuration and number of associated cutting elements.

Roller cone drill bits typically have "composite cone profiles" defined in part by each associated cone profile and the crests of all cutting elements projected onto a vertical plane passing through a composite axis of rotation for all associated cone assemblies. Composite cone profiles for roller cone drill bits and each cone profile generally include the crest point for each associated cutting element.

The terms "mesh" and "mesh analysis" may be used to describe analytic procedures used to evaluate and study complex structures such as cutting elements, cutting structures, roller cones and bottom hole configurations of wellbores drilled in associated earth formations.

Cutting elements often include respective "cutting zones" which may be generally defined as portions of the surface area of each cutting element which contact a downhole formation while drilling a wellbore. The surface area of each cutting element may be finely meshed into many segments to assist with determining an associated cutting zone and distribution of forces or force profile relative to the associated cutting zone. Distribution of the number of contacts and distribution of associated forces acting on each cutting element may be determined by simulating drilling for a selected time interval using mesh analysis. The location and size of each cutting zone and distribution of forces depends in part on the location of each cutting element on an associated cone assembly. The size and configuration of each cutting element also determines the location and size of an associated cutting zone and distribution of forces. A cutting zone may sometimes be located proximate the crest of a cutting element.

Cutting elements and cutting structures also include respective "loading zones", "stress zones" and "wear zones". Loading zones may be determined in accordance with teachings of the present invention based on the location and size of an associated cutting zone and distribution of forces over the respective cutting zone during simulated downhole drilling. Stress zones may be determined in accordance with teachings of the present invention using finite element analysis techniques to analyze respective cutting zones and loading zones associated with each cutting element.

Wear profiles may be determined in accordance with teachings of the present invention based on combining distribution of forces on a respective cutting element or cutting structure and distribution of sliding velocity of the respective cutting element or cutting structure during simulated downhole drilling. The resulting wear profiles may then be analyzed to determine respective wear zones for each cutting element.

"Sliding velocity" may be generally described as the absolute velocity of a cutting element moving relative to a downhole formation or earth formation.

The respective cutting zone, loading zone, stress zone and wear zone for each cutting element on a roller cone drill bit depends upon the location of the cutting element on the respective roller cone assembly and associated roller cone drill bit design parameters. For cutting elements with exactly the same geometry, the cutting zone may be substantially different between the gauge row and an inner row. See FIGS. 9 and 11. The location and size of respective loading zones may also be substantially different. See FIGS. 10 and 12.

Various factors or criteria may be considered in comparing and evaluating drilling performance of roller cone drill bits. Such factors or criteria may include, but are not limited to, comparison of downhole hole drilling life and/or rate of penetration for different drill bit designs when subjected to substantially the same drilling parameters—weight on bit, rate of rotation, downhole formation, diameter of wellbore, etc. Drilling performance may also be based on comparisons of total cost and/or time required to drill a selected downhole formation interval. The present invention allows selecting a wide variety of criteria which may be used to design roller cone drill bits having optimum drilling performance. See FIG. 24.

Various types of cutting elements and cutting structures may be disposed on a roller cone. Compacts 40, inserts 60 and milled teeth 360, which will be discussed later in more detail, are only a few examples of such cutting elements and cutting structures.

Roller cone drill bits with inserts 60 may be designed for drilling relatively hard downhole formations. Rotary cone drill bits having milled teeth 360 are often used to form wellbores in downhole formations having moderate or medium hardness.

For purposes of describing various features of the present invention, cone assemblies 30 may be identified as 30*a*, 30*b* and 30*c*. Cone assemblies 330 may be identified as 330*a*, 330*b* and 330*c*. Cone assemblies 30 and 330 may sometimes be referred to as "roller cones", "rotary cone cutters", "roller cone cutters", "cutter cone assemblies" or "roller cone assemblies".

For some applications cutting elements associated within a cone assembly and roller cone drill bit incorporating teachings of the present invention may have substantially the same dimensions and configurations. Alternatively, some cone assemblies and associated roller cone bits may include cutting elements and cutting structures with substantial variations in both configuration and dimensions of associated cutting elements and cutting structures. The present invention is not limited to roller cone drill bits having cutting elements 40, 60 and 360. Also, the present invention is not limited to roller cone drill bits having roller cones 30 and 330.

FIG. 1 shows one example of a roller cone drill bit having one or more cone assemblies with cutting elements and cutting structures incorporating teachings of the present invention. Roller cone drill bit 20 may be used to form a wellbore (not expressly shown) in a subterranean formation or downhole formation (not expressly shown). Roller cone drill bit 20 typically forms a wellbore by crushing or penetrating a formation and scraping or shearing formation materials from the bottom of wellbore using cutting elements 60. The term "cutting" may be used to describe various combinations of crushing, penetrating, scraping and/or sheering formation materials by cutting elements and cutting structures incorporating teachings of the present invention.

A drill string (not expressly shown) may be attached to threaded portion 22 of drill bit 20 to both rotate and apply weight or force to associated roller cone assemblies 30 as they roll around the bottom of a wellbore. For some applications various types of downhole motors (not expressly shown) may also be used to rotate a roller cone drill bit incorporating teachings of the present invention. The present invention is not limited to roller cone drill bits associated with conventional drill strings.

Roller cone drill bit 20 preferably includes bit body 24 having tapered, externally threaded portion 22 adapted to be secured to one end of a drill string. Bit body 24 preferably includes a passageway (not expressly shown) to communicate drilling mud or other fluids from the well surface through the drill string to attached drill bit 20. Drilling mud and other fluids may exit from nozzles 26. Formation cuttings and other debris may be carried from the bottom of a borehole by drilling fluid ejected from nozzles 26. Drilling fluid generally flows radially outward between the underside of roller cone drill bit 20 and the bottom of an associated wellbore. The drilling fluid may then flow generally upward to the well surface through an annulus (not expressly shown) defined in part by the exterior of roller cone drill bit 20 and an associated drill string and the inside diameter of the wellbore.

The flow of drilling fluids from nozzles 26 may also assist cutting and/or shearing of formation materials from the bottom of a wellbore. Hydraulic forces associated with drilling fluids and/or formation fluids at the bottom of a wellbore may also produce erosion of cutting elements and cutting structures associated with a roller cone drill bit. For purposes of describing various features of the present invention, fluid cutting or shearing of formation materials at the bottom of a wellbore and/or possible erosion of cutting elements and cutting structures will generally not be considered.

For embodiments of the present invention represented by drill bit 20, bit body 24 may have three (3) support arms 32 extending therefrom. The lower portion of each support arm 32 opposite from bit body 24 preferably includes a respective spindle or shaft 34. See FIG. 2. Spindle 34 may also be referred to as a "journal" or "bearing pin". Each cone assembly 30*a*, 30*b* and 30*c* preferably includes respective cavity 48 extending from backface 146. The dimensions and configuration of each cavity 48 are preferably selected to receive an associated spindle 34.

Cone assemblies 30*a*, 30*b* and 30*c* may be rotatably attached to respective spindles 34 extending from support arms 32. Cone assembly 30*a*, 30*b* and 30*c* include respective axis of rotation 36 (sometimes referred to as "cone rotational axis"). The axis of rotation of a cone assembly often corresponds with the longitudinal center line of an associated spindle. Cutting or drilling action associated with drill bit 20 occurs as cutter cone assemblies 30*a*, 30*b* and 30*c* roll around the bottom of a wellbore. The diameter of the resulting wellbore corresponds approximately with the combined outside diameter or gauge diameter associated with gauge face 42 cutter cone assemblies 30*a*, 30*b* and 30*c*.

A plurality of compacts 40 may be disposed in gauge face 42 of each cone assemblies 30*a*, 30*b* and 30*c*. Compacts 40 may be used to "trim" the inside diameter of a wellbore to prevent other portions of gauge face 42 and/or backface 146 from contacting the adjacent formation. A plurality of cutting elements 60 may also be disposed on the exterior of each cone assembly 30*a*, 30*b* and 30*c* in accordance with teachings of the present invention.

Compacts 40 and cutting elements 60 may be formed from a wide variety of hard materials such as tungsten carbide. The term "tungsten carbide" includes monotungsten carbide (WC), ditungsten carbide ($W_2C$), macrocrystalline tungsten carbide and cemented or sintered tungsten carbide. Examples of hard materials which may be satisfactorily used to form compacts 40 and cutting elements 60 include various metal alloys and cermets such as metal borides, metal carbides, metal oxides and metal nitrides. A wide variety of hard materials may be satisfactorily used to form cutting elements and cutting structures in accordance with teachings of the present invention. The present invention allows comparing drill bit designs having cutting elements and cutting structures formed from a wide variety of materials to achieve optimum drilling performance. See FIG. 24.

Rotational axes 36 of cone assemblies 30*a*, 30*b* and 30*c* are preferably offset from each other and rotational axis 38 associated with roller cone bit 20. Axis 38 may sometimes be referred to as "bit rotational axis". The weight of an associated drill string (sometimes referred to as "weight on bit") will generally be applied to drill bit 20 along bit rotational axis 38. For some applications, the weight on bit acting along bit rotational axis 38 may be described as the "downforce". However, many wells are often drilled at an angle other than vertical. Wells are frequently drilled with horizontal portions (sometimes referred to as "horizontal wellbores"). The forces applied to drill bit 20 by a drill string and/or a downhole drilling motor will generally act upon drill bit 20 along bit rotational axis 38 without regard to vertical or horizontal orientation of an associated wellbore. The forces acting on drill bit 20 and each cutting element 60 are also dependent on the type of downhole formation being drilled. Forces acting on each cutting element 60 may vary substantially as drill bit 20 penetrates different formations associated with a wellbore.

Figure 2:
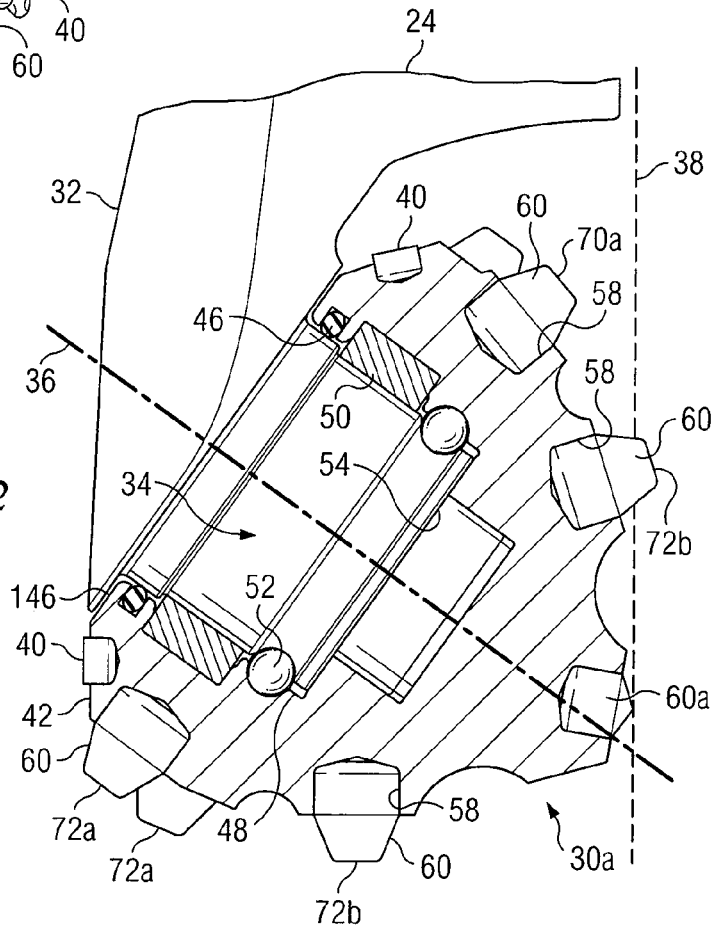
FIG. 2 is a schematic drawing in section and in elevation with portions broken away showing one example of a support arm and associated roller cone having cutting structures designed in accordance with teachings of the present invention.

FIG. 2 shows portions of support arm 34 with cone assembly 30*a* rotatably mounted on spindle 34. Cone assembly 30*a* may rotate about cone rotational axis 36 which may tilt downwardly and inwardly at an angle relative to bit rotational axis 38. Seal 46 may be disposed between the exterior of spindle 34 and the interior of cylindrical cavity 48. Seal 46 forms a fluid barrier between exterior portions of spindle 34 and interior portions of cavity 48 to retain lubricants within cavity 48 and bearings 50 and 52. Seal 46 also prevents infiltration of formation cuttings into cavity 48. Seal 46 protects bearings 50 and 52 from loss of lubricant and from contamination with debris and thus prolongs the downhole life of drill bit 20.

Bearings 50 support radial loads associated with rotation of cone assembly 30*a* relative to spindle 34. Bearings 54 support thrust loads associated with limited longitudinal movement of cone assembly 30 relative to spindle 34. Bearings 50 may sometimes be referred to as journal bearings. Bearings 54 may sometimes be referred to as thrust bearings. Bearings 52 may be used to rotatably engage cone assembly 30*a* with spindle 34.

For embodiments such as shown in FIG. 2, cutting elements 60 may be disposed in rows 72, 72*a* and 72*b* on the exterior of each cone assembly 30*a*, 30*b* and 30*c*. Row 72 may sometimes be described as the "gauge row". Rows 72*a* and 72*b* may sometimes be described as "inner rows".

Insert 60*a* disposed at the end or tip of cone assembly 30*a* may be a different configuration and size as compared with cutting elements 60. Various aspects of the present invention will be described with respect to design of cutting elements 60. However, the same techniques and procedures may also be used to design the location, configuration and size of cutting elements 40 and 60*a*.

Figure 3:
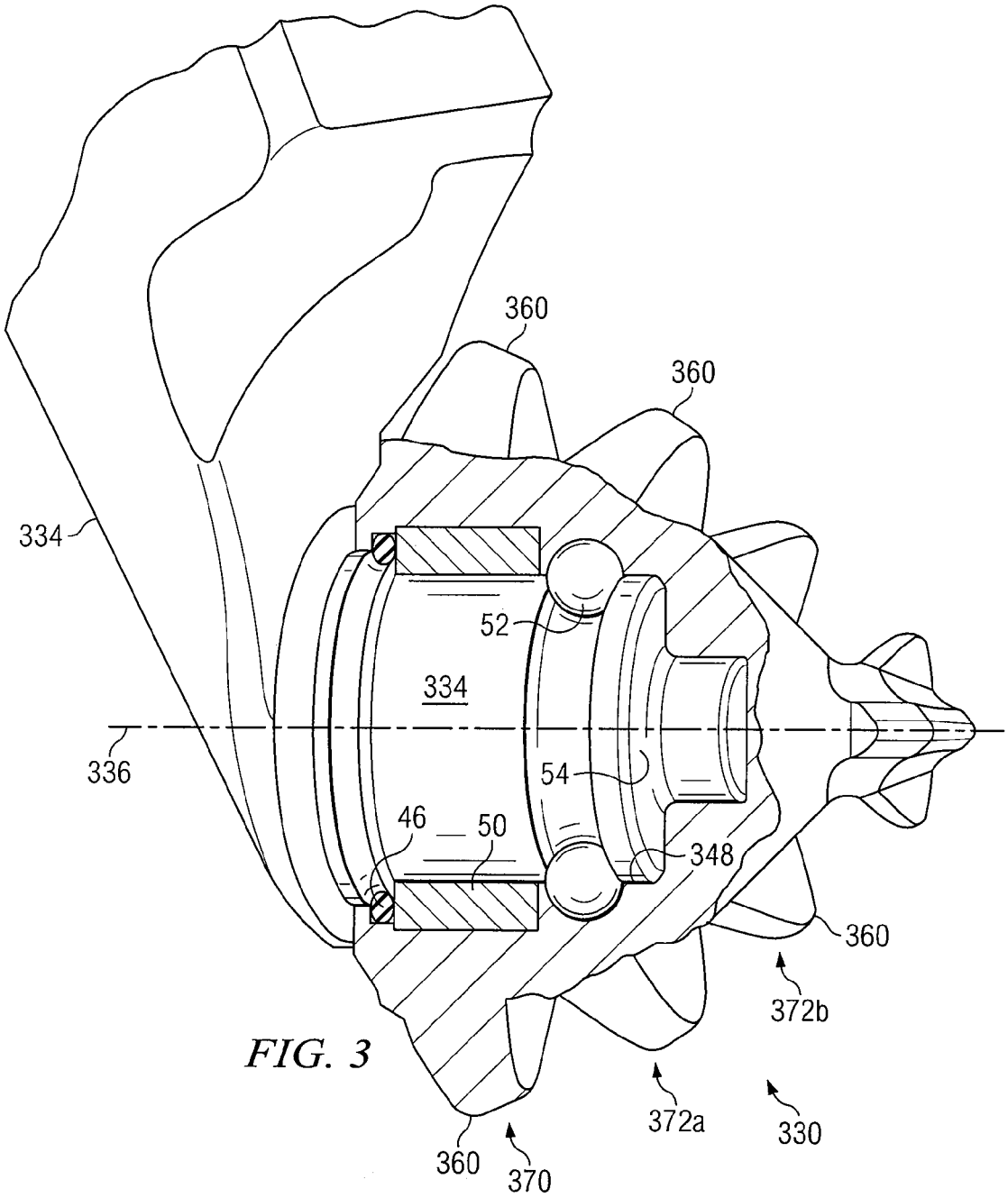
FIG. 3 is a schematic drawing in section and in elevation with portions broken away showing another example of a support arm and associated roller cone having cutting structures designed in accordance with teachings of the present invention.

FIG. 3 shows portions of support arm 334 with a plurality of milled teeth disposed on the exterior of cone assembly 330. Milled teeth 360 may be arranged in gage row 370 and inner rows 372*a* and 372*b* in accordance with teachings of the present invention. The dimensions and configuration of milled teeth 360 may be selected in accordance with teachings of the present invention. The location and size of one or more layers of hardfacing material disposed on milled teeth 360 and the type of hardfacing material may also be selected in accordance with teachings of the present invention. U.S. Pat. No. 5,579,856 entitled "Gage Surface And Method For Milled Tooth Cutting Structure" shows various examples of milled teeth designs and associated layers of hardfacing material.

Cone assembly 330 may be mounted on spindle 334 and rotate about longitudinal axis 336. Spindle 334 may tilt downwardly and inwardly at an angle relative to an associated bit rotational axis. Seal 46 may be disposed between the exterior of spindle 334 and the interior of cylindrical cavity 348. Seal 46 and bearings 50 and 52 perform similar functions as previously described with respect to cone assembly 30 and cone assembly 30*a* and roller cone drill bit 20.

Figure 4:
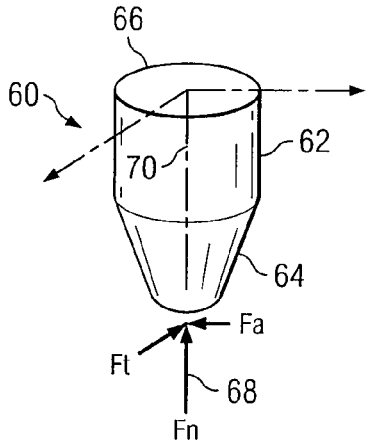
FIG. 4 is a schematic drawing showing an isometric view of one example of a cutting element and typical forces acting on the cutting element during impact with a downhole formation where distributed forces along a cutting zone may be simplified to a crest point of an associated cutting element in a local coordinate system as shown in this FIG. 4.

Respective cone offsets and generally curved cone profiles associated with cone assemblies 30 and 330 may result in cutting elements 60 and 360 impacting a formation with a crushing or penetrating motion and a scraping or shearing motion. FIG. 4 is a schematic drawing showing forces which typically act on cutting element 60 during impact with a formation and cutting of materials from the formation. The forces include normal force $F_n$, radial force $F_a$ and tangent force $F_t$. Similar forces may act on cutting elements 360.

Cutting element 60 as shown in FIG. 4 may include generally cylindrical body 62 with extension 64 extending therefrom. Base portion 66 of cylindrical body 62 may be designed to fit within corresponding sockets or openings 58 in cone assemblies 30*a*, 30*b* and 30*c*. For some applications cylindrical body 62 and extension 64 may be formed as integral components from substantially the same mixture of hard materials. For other applications cylindrical body 62 and extension 64 may be formed with different mixtures of hard materials. See for example FIGS. 18 and 19.

Extension 64 may have various configurations which include a crest. Various types of press fitting techniques may be satisfactorily used to securely engage each cutting element 60 with respective sockets or opening 58. For some applications cutting element 60 may be generally described as an insert.

Normal force $F_n$ typically results directly from the weight placed on a roller cone drill bit by an associated drill string and/or forces applied by a downhole drill motor. Associated weight on bit and/or drill motor forces are primarily responsible for each cutting element penetrating or crushing the formation. Radial force $F_a$ and tangent force $F_t$ depend upon the magnitude of scraping or shearing motion associated with each cutting element. The amount of shearing or scraping depends upon various drill bit design parameters such as orientation of each cutting element, offset of an associated cone assembly and associated cone assembly profile. The design, configuration and size of each cutting element also determines the value of radial force $F_a$ and tangent force $F_t$. For many downhole drilling applications normal force $F_n$ is usually much larger in magnitude than either radial force $F_a$ or tangent force $F_t$.

Normal force $F_n$ will generally act along a normal force vector or axis extending from the center of an associated cutting zone. For some applications, the normal force vector may correspond approximately with the longitudinal axis or geometric axis of an associated cutting element. For other applications, the normal force axis may be offset from the geometric axis depending upon the configuration and orientation of each cutting element relative to an associated cutting zone and cone rotational axis.

Various types of computer simulations may be satisfactorily used to determine when each cutting element 60 impacts portions of an adjacent formation during drilling with drill bit 22. The combined forces or loads placed on each cone assembly 30*a*, 30*b* and 30*c* may be summarized as the net result of all forces acting on compacts 40 and cutting elements 60 of the respective cone assembly. Each cone assembly 30*a*, 30*b* and 30*c* may be considered as a rigid body which allows simplification of cone forces into three orthogonal linear forces and three orthogonal moments as shown in FIG. 1.

Orthogonal linear forces ($F_x$, $F_y$, $F_z$) and orthogonal moments ($M_x$, $M_y$, $M_z$) may be analyzed using a cone coordinate system defined in part by the Z axis which extends along the associated cone rotational axis. For cone assemblies 30*a*, 30*b* and 30*c*, the X axis and the Y axis preferably intersect with each other and the Z axis proximate the intersection of cone rotational axis 36 and the exterior surface of associated support arm 32. The Z axis corresponds generally with cone rotational axis 36. See FIG. 1.

Moment $M_z$ measured relative to cone rotational axis 36 generally corresponds with torque on an associated cone assembly 30. Moment $M_z$ is normally balanced by rotation of the associated cone assembly 30. Moments $M_x$ and $M_y$ often cause each cone assembly 30 to wobble relative to associated spindle 34. The bearing system associated with each cone assembly 30 must balance or absorb the moments $M_x$ and $M_y$.

For most rotary cone drill bits, normal force $F_n$ from associated cutting elements is often the most significant contributor to moments $M_x$ and $M_y$.

Normal force $F_n$ generally results from the total force applied to drill bit 20 along bit rotational axis 38. The value of normal force $F_n$ depends upon factors such as the angle of associated cone rotational axis 36, offset of the associated cone assembly relative to bit rotational axis 38 and associated cone profile. For some embodiments, normal force $F_n$ may act along normal force axis 68 which may be generally aligned with longitudinal axis or geometric axis 70 of cutting element 60. See FIG. 4.

The forces and moments acting on roller cone drill bit 20 may also be analyzed using a drill bit coordination system (not expressly shown) defined in part by a Z axis which generally extends along associated bit rotational axis 38. Associated X axis and Y axis preferably intersect with each other and the Z axis. A plane defined by the X axis and Y axis is perpendicular to the Z axis.

The location and size (area) of respective cutting zones on cutting elements and cutting structures associated with a roller cone drill bit generally depend upon both associated drill bit design parameters and associated drilling parameters. Therefore, computer simulations or computer modeling incorporating teachings of the present invention may be used to determine cutting zones, loading zones, stress zones and wear zones of associated cutting elements in accordance with teachings of the present invention. U.S. Pat. No. 6,095,262 entitled Roller-cone bits, systems, drilling methods, and design methods with optimization of tooth orientation and U.S. Pat. No. 6,213,225 entitled Force-balanced roller-cone bits, systems, drilling methods, and design methods show examples of computer modeling or computer simulation which may be used to determine interaction between cutting elements and a downhole formation. Such computer modeling and/or simulations may be used to provide three dimensional representations of drill bit designs and down hole formations.

Computer simulations incorporating teachings of the present invention may be satisfactorily used to optimize the design of a roller cone drill bit including optimizing type, size, orientation and materials used to form associated cutting elements and cutting structures to increase the rate of penetration and to energy balance, force balance or work balance associated cutting structures. One aspect of the computer simulation includes developing three dimensional mesh representations of associated cutting elements and cutting structures. Three dimensional mesh representations of the cutting elements and a three dimensional mesh representation of a downhole formation may be used to determine interactions of each cutting element with the downhole formation. For example, the volume of downhole formation removed by each cutting element during one revolution of an associated roller cone drill bit may be used to calculate forces acting upon each cutting element and may be used to update the configuration or pattern of the associated bottom hole.

The location and size of respective cutting zones for each cutting element may depend on both drilling parameters and drill bit design parameters. Some drilling parameters which affect the location and size of cutting zones may include, but are not limited to, weight on bit, rate of penetration, rate of drill bit rotation, depth of borehole, bottom hole temperature, bottom hole pressure, deviation of the wellbore from vertical, distance from an associated well surface, type of formation, hardness of formation and diameter of the wellbore. For example, the location and size of a cutting zone for a given cutting element design will generally increase with increased rate of penetration and/or with increased weight on bit.

Some drill bit design parameters which affect the location and size of cutting zones may include, but are not limited to, type of cutting element, size, configuration and number of cutting elements, offset of each roller cone, associated roller cone profile, number of roller cones, number of rows of cutting elements on each roller cone, number of cutting elements in each row, location of each cutting element, orientation of each cutting element and angle of spindle or bearing pin associated with each roller cone.

Since the location and size of a cutting zone depends upon both drill bit design parameters and drilling parameters, the location and size of respective cutting zones for cutting elements 60 and 360 may vary substantially even though each cutting element 60 has substantially the same size and configuration and each cutting element 360 may have substantially the same size and configuration. The variation may occur between cutting elements in a gauge row and the inner rows or may vary for cutting elements on the first cone as compared with cutting elements on the second and third cone. See FIGS. 15A, 15B, 15C, 16A, 16B and 16C.

Figure 5:
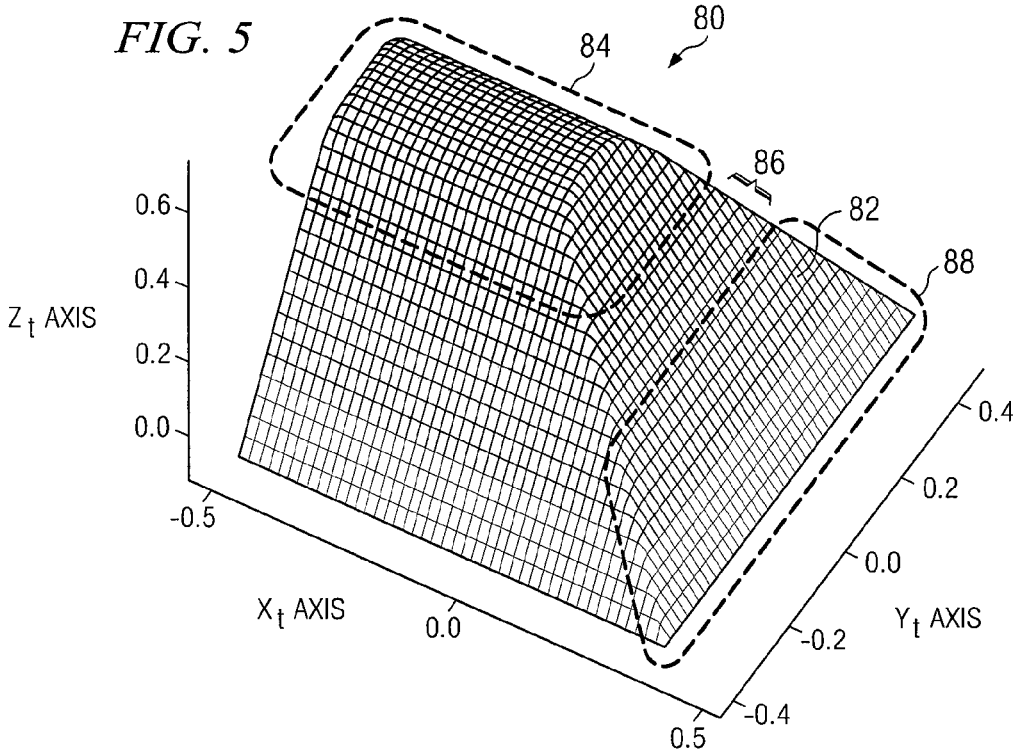
FIG. 5 is a schematic drawing showing a three dimensional meshed representation of a chisel shaped cutting element.

FIG. 5 shows three dimensional mesh 80 of a generally chisel shaped cutting element represented by three matrices, $X_t$, $Y_t$ and $Z_t$. Mesh 80 may be representative of some types of milled teeth. However, inserts may also be formed with a chisel shaped configuration in accordance with teachings of the present invention. The nominal configuration and size for each mesh segment shown in FIG. 5 may be generally described as a square with 0.5 millimeters sides. However, the actual configuration and size of each mesh segment 82 may vary substantially due to the complex geometry of the associated cutting element.

Computer simulation techniques incorporating teachings of the present invention may be used to locate or determine an associated cutting zone and force profile or force distribution over the cutting zone for the cutting element corresponding with mesh 80. Information concerning the cutting zone and associate force profile may be used to determine an associated loading zone. Associated stress zones and wear zones may also be determined for use in designing each cutting element, roller cone and associated drill bit. For example, the thickness and location of hardfacing material disposed on exterior portions of a cutting element may be modified based on stress zones and wear zones as determined by such computer simulations. Determining the location of stress zones and wear zones may also be used to predict failure modes of the associated cutting element.

Based on selected drill bit design parameters and selected drilling parameters, a computer simulation incorporating teachings of the present invention may indicate a relatively high number of contacts between mesh segments 82 in portion 84 of mesh 80 and portions of a meshed earth formation. See FIGS. 7 and 8. The same computer simulation indicates a relatively small number of contacts with mesh segments 82 in portion 86 and substantially zero or no contacts between mesh segments 82 in portion 88 and the earth formation. As a result, portion 84 of mesh 80 may correspond with the cutting zone of the associated cutting element for the selected drill bit design parameters and selected drilling parameters.

Figure 6:
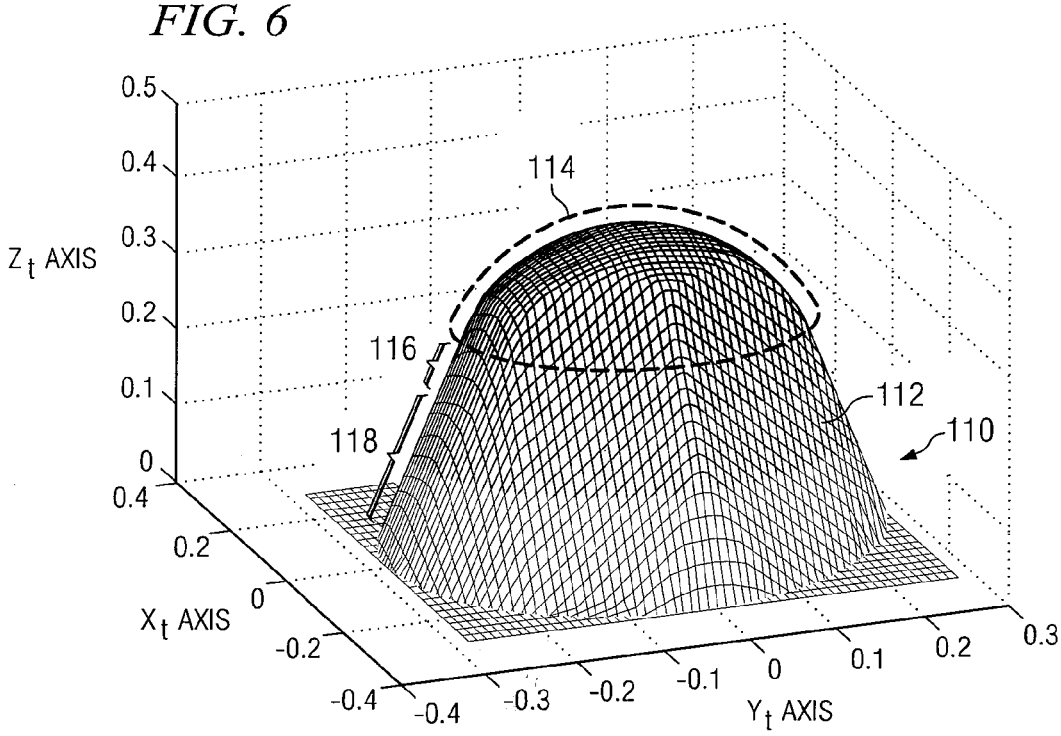
FIG. 6 is a schematic drawing showing a three dimensional meshed representation of a cone shaped or spear shaped cutting element.

FIG. 6 shows three dimensional mesh 110 of a generally dome shaped or spear shaped cutting element. Mesh 110 may be represented by three matrices, $X_t$, $Y_t$, and $Z_t$. Mesh 110 may be characteristic of some types of inserts. However, milled teeth may also be formed with a dome shaped or spear shaped configuration in accordance with teachings of the present invention. Mesh 110 may include segments 112 with the same nominal configuration and size as described for mesh segments 82. However, the actual configuration and size of each mesh segment 112 may vary substantially due to the complex geometry of the associated cutting element.

Computer simulation techniques incorporating teachings of the present invention may be used to locate or determine an associated cutting zone and force profile over the cutting zone for the cutting element associated with mesh 110. Information concerning the cutting zone and associated force profile may be used to determine an associated loading zone. Associated stress zones and wear zones may also be determined for use in designing each cutting element, roller cone and associated drill bit in accordance with teachings of the present invention.

Based on selected drill bit design parameters and selected drilling parameters, a computer simulation incorporating teachings of the present invention may indicate a relatively high number of contacts between mesh segments 112 in portion 114 of mesh 110 and a mesh representation of an earth formation. The same computer simulation may indicate a relatively small number of contacts with mesh segments 112 in portion 116 and substantially zero or no contacts between mesh segments 112 in portion 118 and the earth formation. As a result, portion 114 of mesh 110 may correspond with the cutting zone of the associated cutting element for the selected drill bit design parameters and selected drilling parameters.

Cutting zone 84 of mesh 80 and cutting zone 114 of mesh 110 indicate that the selected rate of penetration and/or weight on bit is large enough such that cutting zones 84 and 114 substantially cover the respective end of the corresponding cutting element. However, if the selected rate of penetration and/or weight on bit is small, the area of cutting zone 84 of mesh 80 and cutting zone 114 of mesh 110 may be much smaller.

Figure 7:
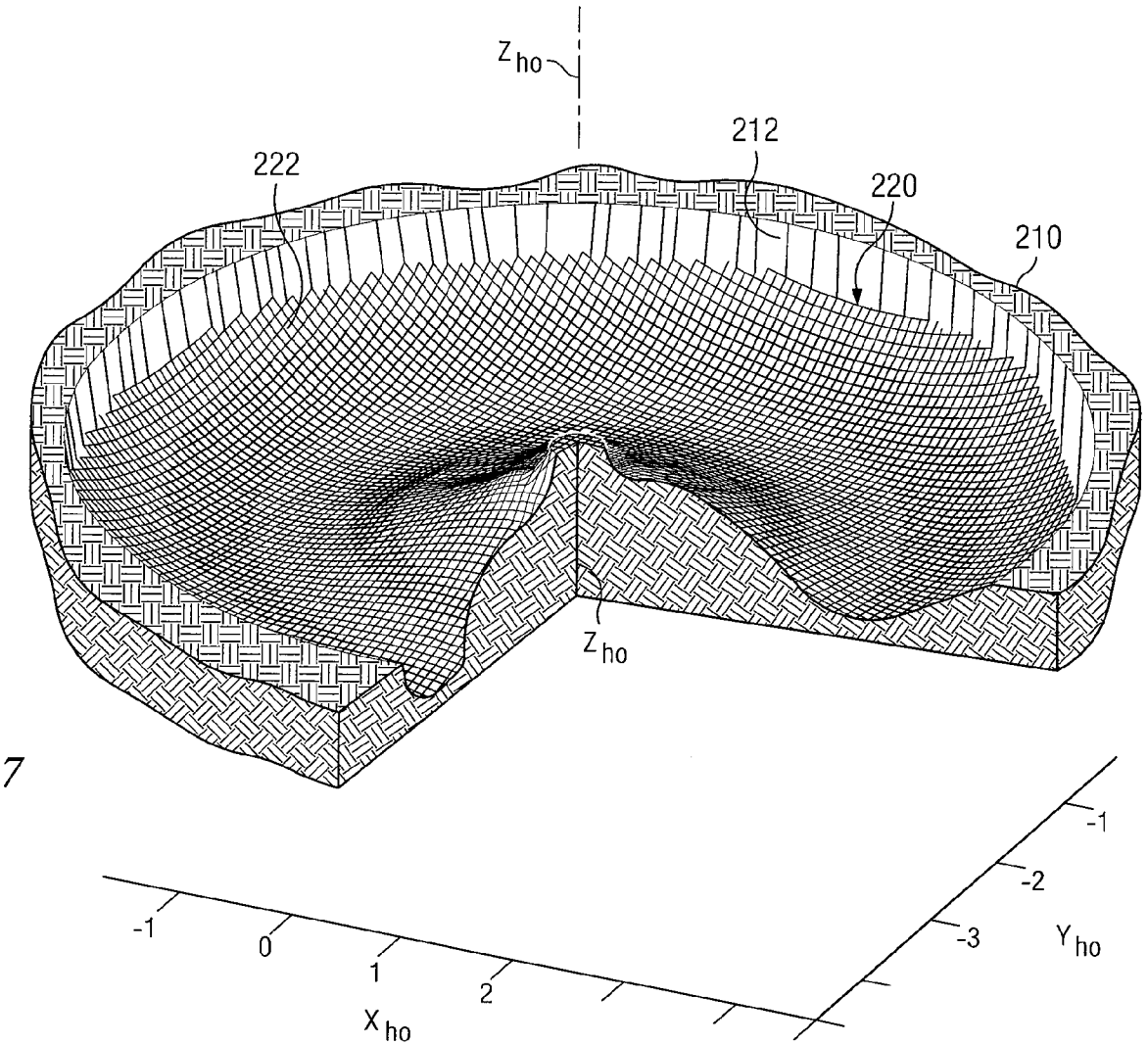
FIG. 7 is a schematic drawing showing a three dimensional meshed representation of a bottom hole before simulating drilling for a selected time internal.

FIG. 7 is a schematic drawing in section and in elevation with portions broken away showing downhole formation 210 with bottom hole 212 formed therein. Bottom hole 212 may correspond with the end of a wellbore (not expressly shown) extending from a well surface (not expressly shown) through various types of earth formations. Bottom hole 212 may be formed by a roller cone drill bit designed in accordance with teachings of the present invention. For example, a roller cone drill bit having cutting elements corresponding with mesh 80 or cutting elements corresponding with mesh 110 may be used to form bottom hole 212. The diameter of the wellbore (not expressly shown) and bottom hole 212 may correspond approximately with the gauge diameter of the drill bit used to form the wellbore and associated bottom hole 212.

FIG. 7 also shows three dimensional mesh 220 corresponding with bottom hole 212. Mesh segments 222 may have substantially the same nominal configuration and size as described for mesh segments 82. However the actual configuration and size of each mesh segment 222 may vary substantially due to the complex geometry of bottom hole 212.

Mesh 220 may be represented by three matrices, $X_h$, $Y_h$ and $Z_h$. For some applications mesh 220 shown in FIG. 7 may be considered as the initial state or initial condition of bottom hole 212 prior to simulating interactions with a respective drill bit design. Therefore, segments 222 as shown in FIG. 7 may have values of $X_{h0}$, $Y_{h0}$ and $Z_{h0}$.

Matrices $X_t$, $Y_t$ and $Z_t$ for a respective cutting element, cone assembly and/or drill bit design may be mathematically transformed to the same coordinate system as a respective bottom hole mesh before considering interaction between the respective cutting element, cone assembly and/or drill bit design and adjacent portions of the bottom hole. For example, matrices $X_t$, $Y_t$ and $Z_t$ may be mathematically transformed for mesh 80 or mesh 110 onto the same coordinate system as mesh 220.

Figure 8:
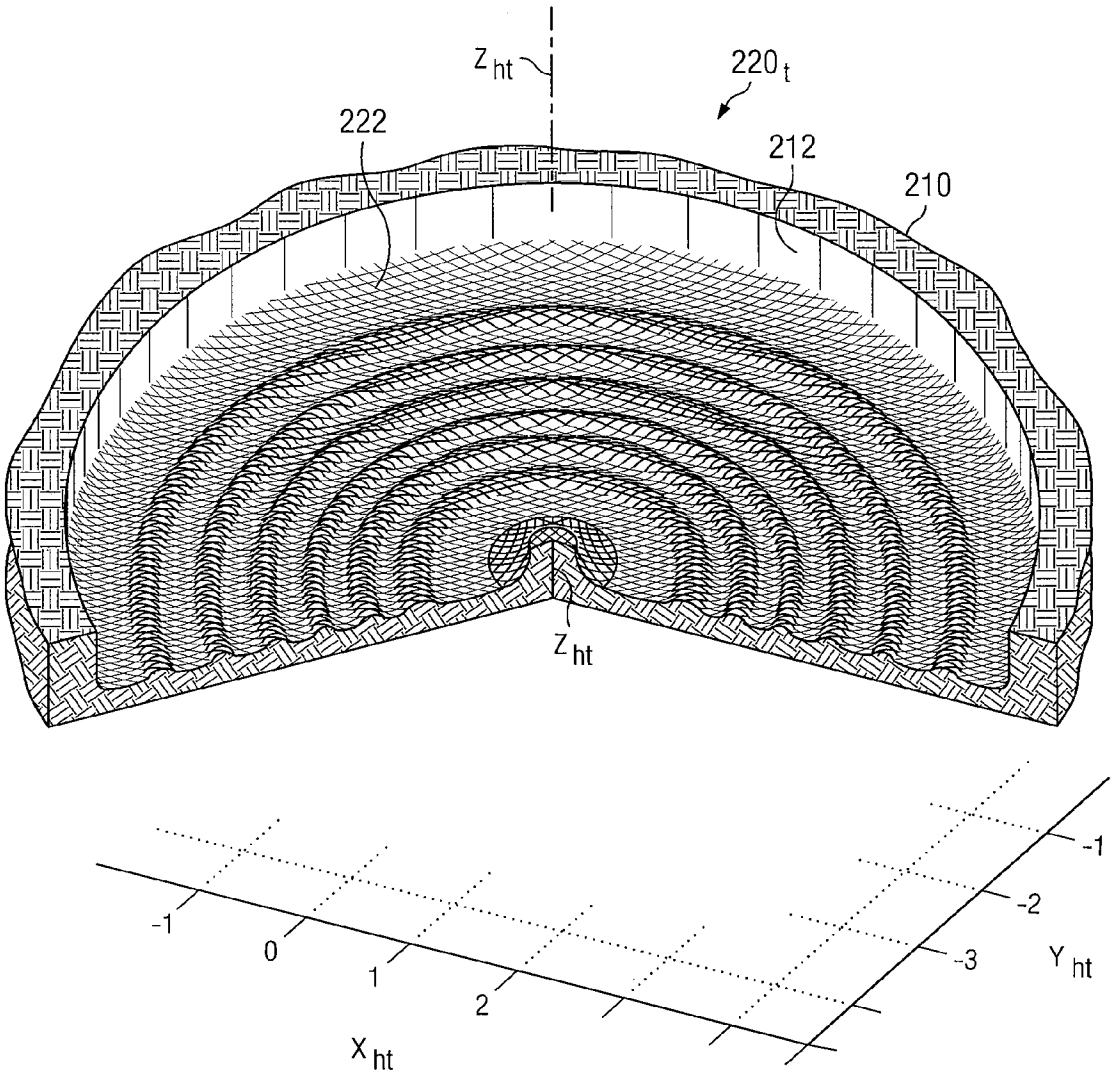
FIG. 8 is a schematic drawing showing a three dimensional meshed representation of a bottom hole after simulating drilling for the selected time internal.

FIG. 8 is a schematic drawing in section and in elevation with portions broken away showing bottom hole 212 after interaction between cutting elements of an associated roller cone drill bit design and adjacent portions of bottom hole 212. For example, cutting elements 60 associated with roller cone drill bit 20 may be meshed into respective mesh segments 82. Computer simulation may then be used to simulate drilling an additional distance through an earth formation or downhole formation 210 starting with borehole 212 in an initial state as shown in FIG. 7.

Roller cone drill bit 20 with cone assemblies 30*a*, 30*b*, 30*c* and associated cutting elements 40 and 60 may be simulated as rolling around or engaging adjacent portions of downhole formation 210 for time interval or time increment t. The interaction between mesh segments 82 of each cutting element 60 and mesh segments 222 of mesh 220 may be used to simulate cutting elements 60 cutting into or removing adjacent portions of bottom hole 212.

The cutting zone for each cutting element during time interval t may be determined based on respective contacts between mesh segments 82 and mesh segments 222. The contacts may be represented by coordinate points $X_{ti}$, $Y_{ti}$ and $Z_{ti}$ where i=n1~n2. At time t+Δt, the cutting zone for the same cutting elements may be determined and represented by $X_{tj}$, $Y_{tj}$ and $Z_{tj}$ where j=n3~n4. At a later time t+kΔt a portion of each cutting element will cut into adjacent portions of a downhole formation. The associated cutting zone may be determined and represented for time interval t+Δt by the same three matrices. At each time interval, respective cutting zones may be determined for the associated cutting element and represented by three matrices. Post analysis may then be used to determine the number of contacts with each mesh segment 82 in the respective cutting zone during a selected time interval. The meshed segments associated with at least a minimum number of contacts may be determined. These mesh segments form the cutting zone for the associated cutting element. See for example cutting zone 84 in FIG. 5 and cutting zone 114 in FIG. 6.

Simulating drilling of a downhole formation in selected time intervals in accordance with teachings of the present invention, may be used to determine the location and size of respective cutting zones for each cutting element represented in coordinate systems associated with the cutting element, cone assembly and/or drill bit. Each cutting zone may be represented by mesh segments having at least a minimum number of contacts with portions of the downhole formation. The total number of contacts or cuts for a given time interval may be determined for each cutting element. Some of the mesh segments may only cut or contact the downhole formation during a small number of time intervals. Other mesh segments may cut or contact the downhole formation during a large number of time intervals. Mesh segments which contact the downhole formation most of the time form a "core cutting zone" within the overall cutting zone. For example, simulating interaction between a cutting element associated with mesh 80 as shown in FIG. 5 with bottom hole 212 having mesh 220 as shown in FIGS. 7 and 8 indicates that the associated cutting zone 84 includes core cutting zone 84*a* when the associated cutting element is disposed in a gauge row of a roller cone. See FIG. 9.

Simulation of drilling with multiple drill bit designs and multiple drilling parameters indicates that the core cutting zone of a typical cutting element remains relatively constant with changes in associated drilling parameters. As a result, after a cutting element and associated drill bit have been designed, respective core cutting zones of each cutting element may remain relatively constant despite changes in drilling parameters.

A respective force profile over each cutting zone of each cutting element may be determined in accordance with teachings of the present invention using procedures and techniques similar to those used to determine cutting zones. At the end of each time interval or time increment, forces acting on a respective cutting zone may be represented by six matrices $X_t$, $Y_t$, $Z_t$, $F_n$, $F_t$ and $F_r$. The first three matrices represent the location and size of the respective cutting zone. The last three matrices represent the normal force, the tangent force and the radial force acting on respective mesh segments disposed within the cutting zone. See FIG. 4 for directions of $F_n$, $F_t$ and $F_r$.

Simulating drilling of a downhole formation in selected time intervals in accordance with teachings of the present invention, may be used to determine the average force acting on each mesh segment disposed within respective cutting zones over several time intervals. The average force acting on each mesh segment forms the force profile over the respective cutting zone. The location and size of respective loading zones for associated cutting elements may be represented in coordinate systems associated with the cutting elements, respective cone assembly and/or drill bit. See for example loading zone 90 in FIG. 10.

Each loading zone may be defined by mesh segments having an average force equal to or above a selected minimum value. Some mesh segments may only be subjected to the minimum average force during a small number of time intervals. Other mesh segments may be subjected to at least the minimum average force during most of the time intervals. These mesh segments form a "core loading zone" within the overall loading zone. See for example core loading zone 90*a* in FIG. 10.

Figure 9:
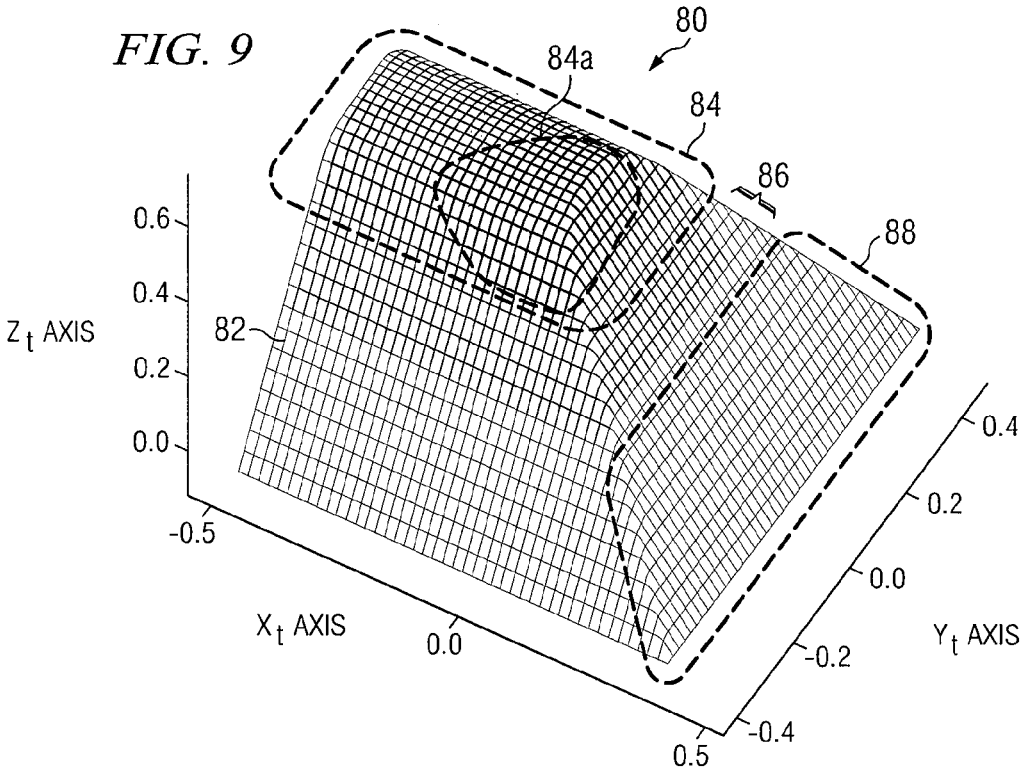
FIG. 9 is a schematic drawing showing a three dimensional meshed representation of a cutting zone and a core cutting zone for a cutting element disposed in a gauge row of a roller cone.

FIG. 9 is a schematic drawing showing a three dimensional representation of a cutting zone and a core cutting zone for a cutting element having mesh 80 such as shown in FIG. 5. For this embodiment the cutting element may be disposed in a gauge row of a roller cone. As previously discussed, portion 86 of mesh 80 has a relatively small number of contacts and portion 88 has substantially zero contacts with adjacent bottom hole 212.

Figure 10:
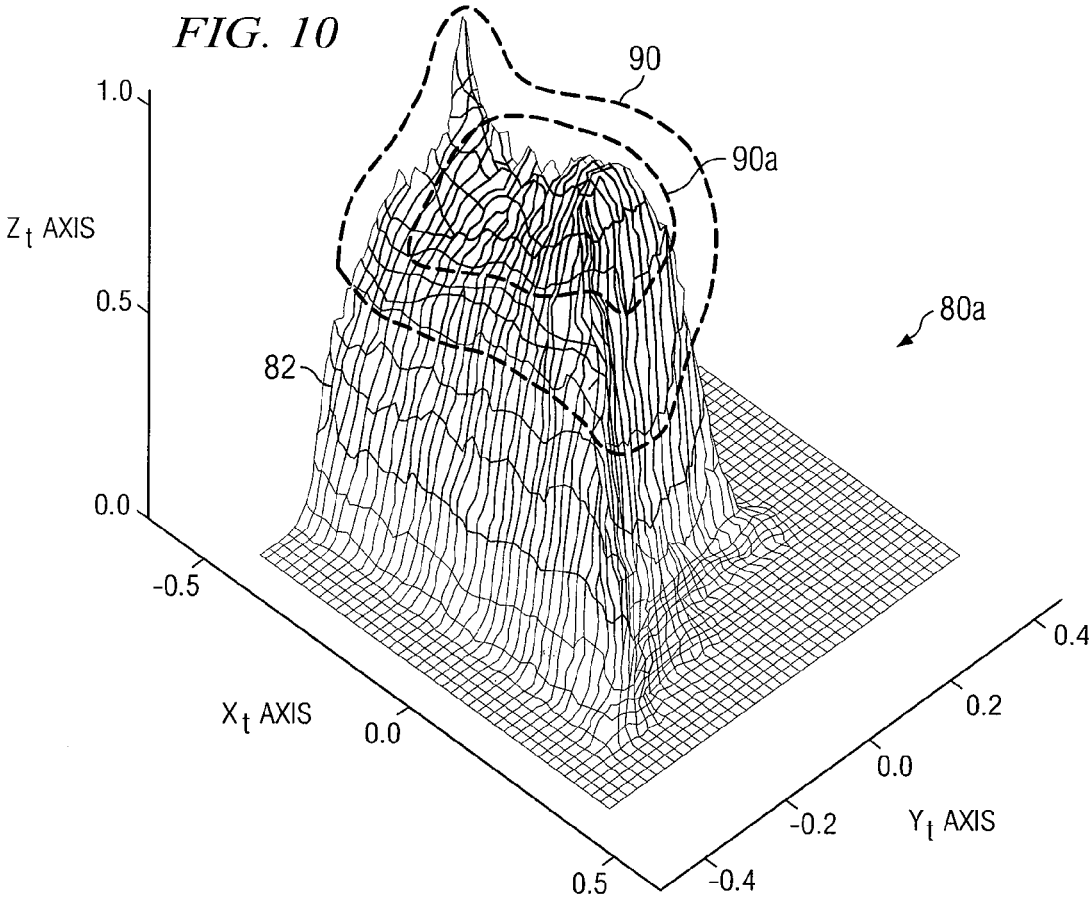
FIG. 10 is a schematic drawing showing a three dimensional meshed representation of a loading zone and a core loading zone for the cutting element of FIG. 9.

Mesh 80*a* as shown in FIG. 10 is the distribution of the average force acting on each mesh segment 82. Therefore, the configuration of mesh 80*a* is substantially different from the configuration of mesh 80. Simulating interactions between mesh 80 as shown in FIG. 9 and bottom hole 220 having mesh 220 as shown in FIGS. 7 and 8 indicates that the corresponding cutting element may have loading zone 90 and core loading zone 90*a* when the associated cutting element is disposed in the gauge row of the roller cone.

Simulation of drilling with multiple drill bit designs and multiple drilling parameters indicates that the core loading zone of a typical cutting element remains relatively constant with changes in associated drilling parameters. As a result, after a cutting element and associated drill bit have been designed, the respective core loading zone for each cutting element may remain relatively constant despite changes in downhole drilling parameters.

Figure 11:
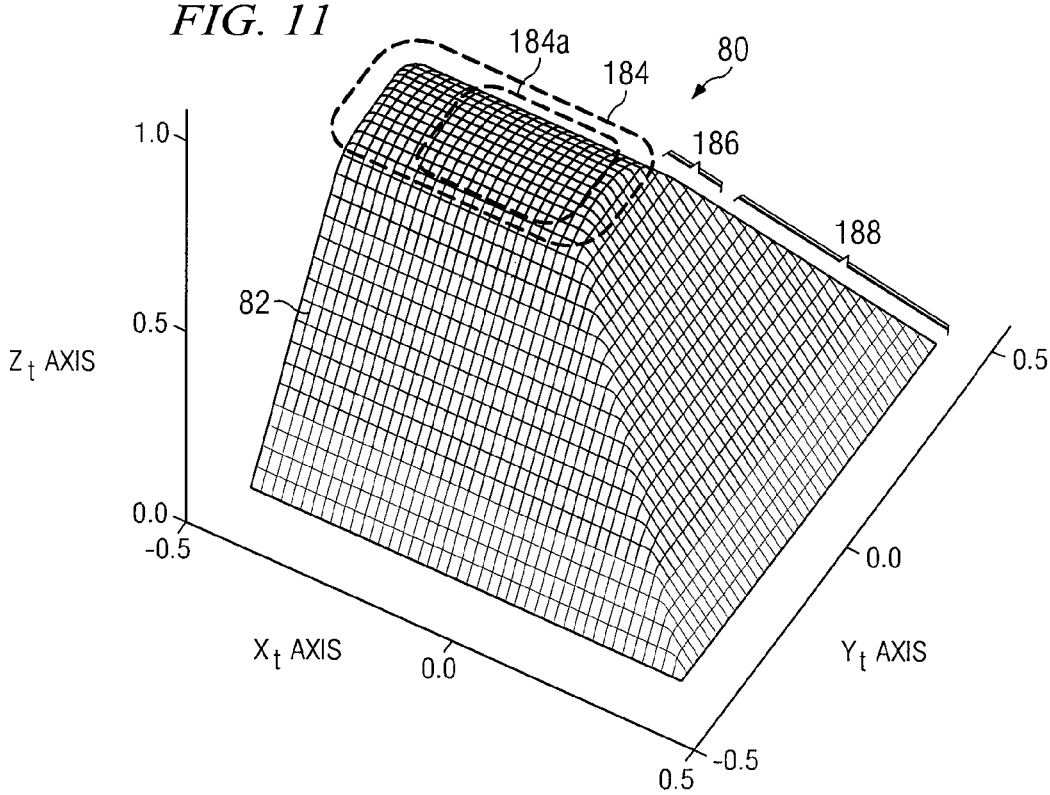
FIG. 11 is a schematic drawing showing a three dimensional meshed representation of a cutting zone and a core cutting zone for the cutting element of FIG. 9 disposed in an inner row of the roller cone.
Figure 12:
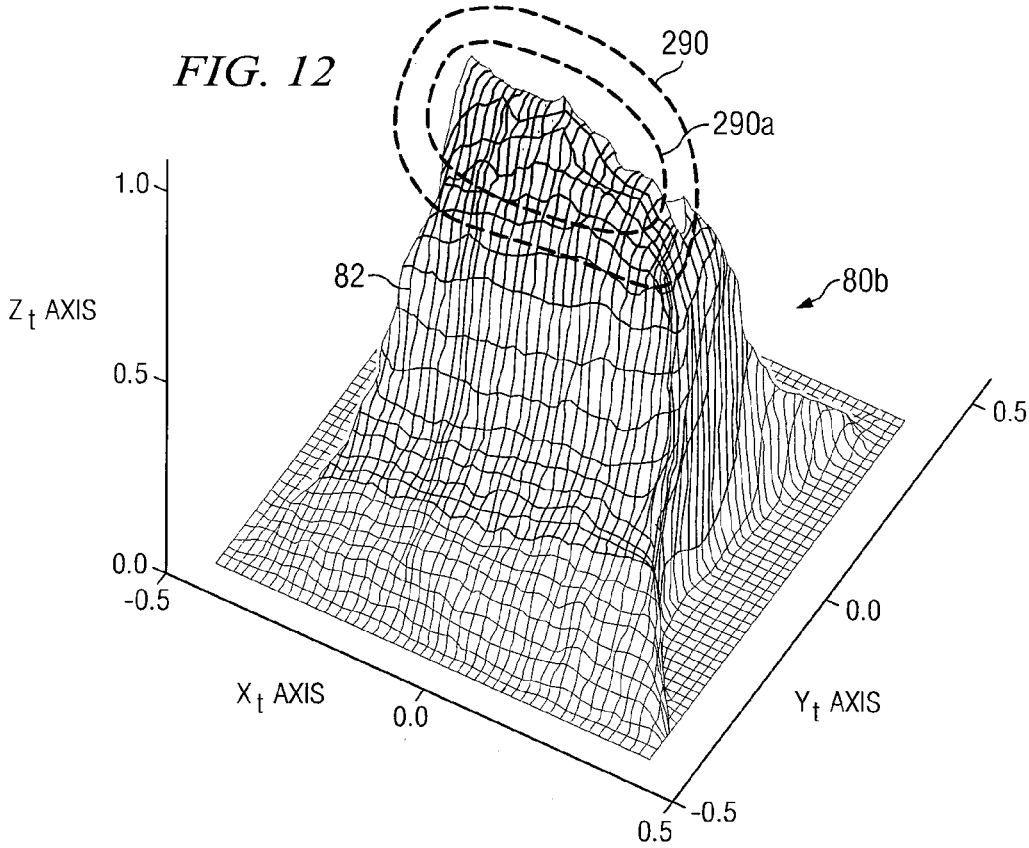
FIG. 12 is a schematic drawing showing a three dimensional meshed representation of a loading zone and a core loading zone for the cutting element of FIG. 9 disposed in the inner row of the roller cone.

FIGS. 11 and 12 show variations in cutting zones and loading zones associated with changing the location of a cutting element on an associated roller cone assembly. The same three dimensional mesh may generally be used for a cutting element whether disposed in the gauge row or an inner row of an associated roller cone. FIG. 11 includes substantially the same mesh 80 for the same cutting element as shown in FIG. 5.

Using the same drilling parameters and the same drill bit design parameters, except for changing the location of the cutting element from the gauge row to an inner row, a computer simulation incorporating teachings of the present invention may indicate a relatively high number of contacts between mesh segments 82 in portion 184 of mesh 80 and portions of an earth formation. The same computer simulation may indicate a relatively small number of contacts with mesh segments 82 in portion 186 and substantially zero or no contacts between mesh segments 82 in portion 188 and the earth formation. As a result portion 184 of mesh 80 as shown in FIG. 11 may correspond with the cutting zone when the associated cutting element is disposed in an inner row for the same drill bit design parameters and drilling parameters as compared with the same cutting element disposed in the gauge row. Compare FIGS. 9 and 11.

Mesh 80*b* as shown in FIG. 12 is the distribution of the average force acting on each mesh segment 82. Therefore, the configuration of mesh 80*b* is substantially different from the configuration of mesh 80. Simulating interactions between mesh 80 as shown in FIG. 11 and bottom hole 212 having mesh 220 as shown in FIGS. 7 and 8 indicates that mesh 80*b* includes loading zone 290 and core loading zone 290*a* when the associated cutting element is disposed in the inner row of the roller cone.

Figure 13:
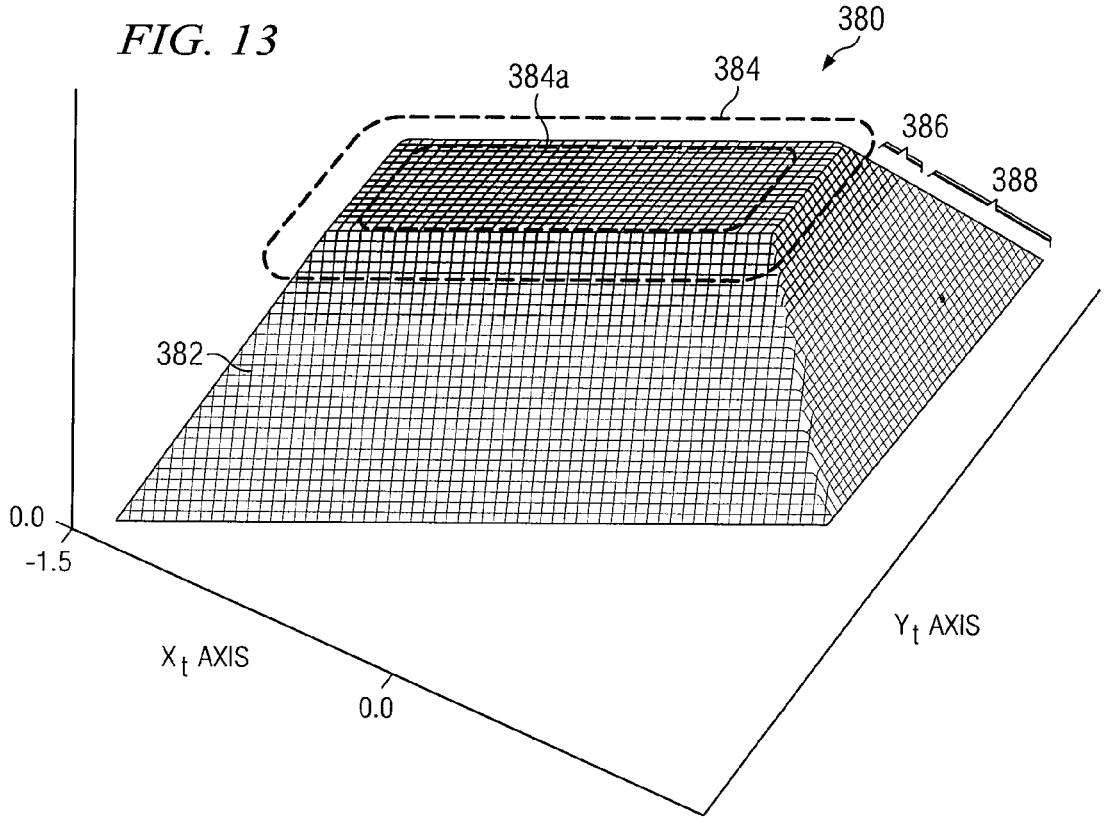
FIG. 13 is a schematic drawing showing a three dimensional meshed representation of a cutting zone and a core cutting zone for another cutting element disposed on a roller cone.
Figure 14:
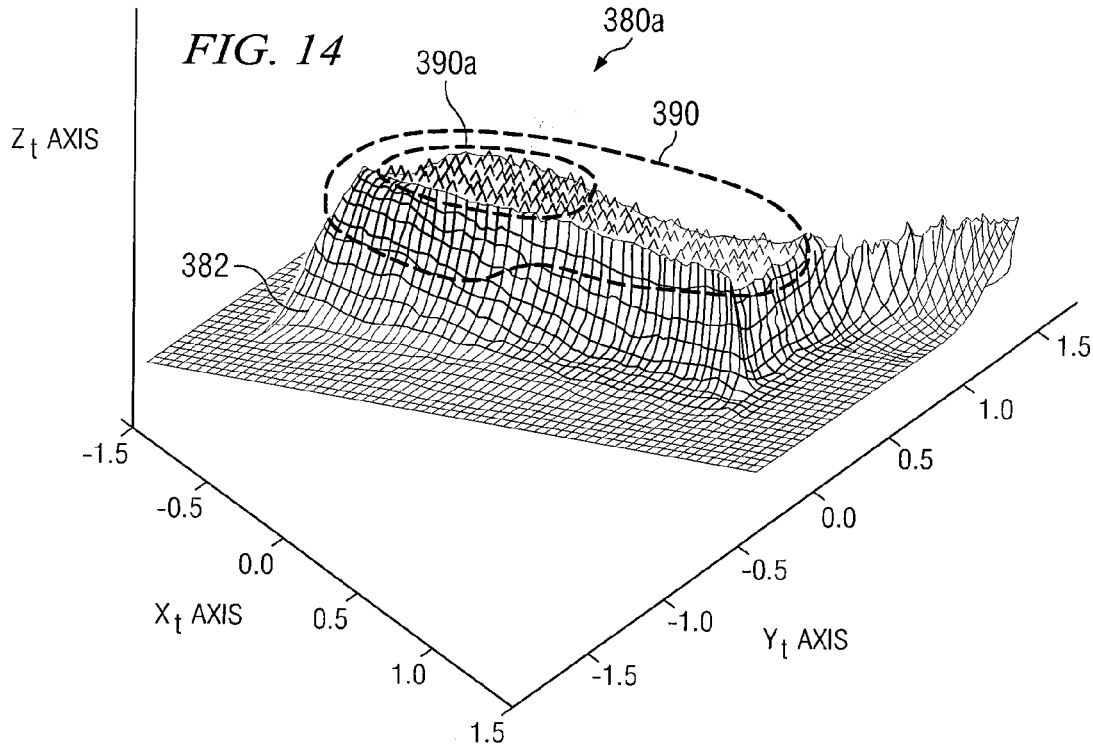
FIG. 14 is a schematic drawing showing a three dimensional meshed representation of a loading zone and a core loading zone for the cutting element of FIG. 13.

FIGS. 13 and 14 are schematic drawings showing three dimensional mesh representations of a cutting zone, core cutting zone, loading zone and core loading zone which may be calculated or determined in accordance with teachings of the present invention.

FIG. 13 shows three dimensional mesh 380 which may correspond with a milled tooth formed on exterior portions of a roller cone. See for example roller cone 330 and cutting elements 360 in FIG. 3. Mesh 380 may include segments 382 with the same nominal configuration and size as described for mesh segments 82. However, the actual configuration and size of each mesh segment 382 may vary substantially due to the complex nature of the associated milled tooth.

Computer simulations incorporating teachings of the present invention may be used to locate or determine associated cutting zone 384 and core cutting zone 384*a* based on the number of contacts with mesh segments 382 and portions of an earth formation. The same computer simulation may indicate a relatively small number of contacts with mesh segments 382 in portion 386 and substantially zero or no contacts between mesh segments 382 in portion 388 and the earth formation.

Mesh 380*a* as shown in FIG. 14 is the distribution of the average force acting on each mesh segment 382. Therefore, the configuration of mesh 380*a* is substantially different from the configuration mesh 380. Simulating interactions between mesh 380 as shown in FIG. 13 and a meshed representation of a bottom hole may indicate that the associated milled tooth will have loading zones 390 and core loading zone 390*a*.

Similar procedures and techniques may be used to determine a respective force profile over cutting zone 384 associated with the milled tooth in accordance with teachings of the present invention. At the end of each time interval or time increment, forces acting on cutting zone 384 may be represented by matrices $X_t$, $Y_t$, $Z_t$, $F_n$, $F_t$ and $F_r$.

Simulating drilling of a downhole formation in selected time intervals in accordance with teachings of the present invention may be used to determine the average force acting on each mesh segment 382 disposed within cutting zone 384.

The average force acting on each mesh segment 382 forms the force profile for cutting zone 384. The location and size of respective loading zone 390*a* may be represented by coordinates associated with the cutting element, respective cone assembly and/or drill bit.

Loading zone 390 may be defined by mesh segments 382 having an average force equal to or above a selected minimum value. Some mesh segments 382 may be subjected to the minimum force during only a small number of time intervals. Other mesh segments 382 may be subjected to at least the minimum average force during most of the time intervals. These mesh segments 382 form core loading zone 390*a* within loading zone 390. See FIG. 14.

Figure 15A:
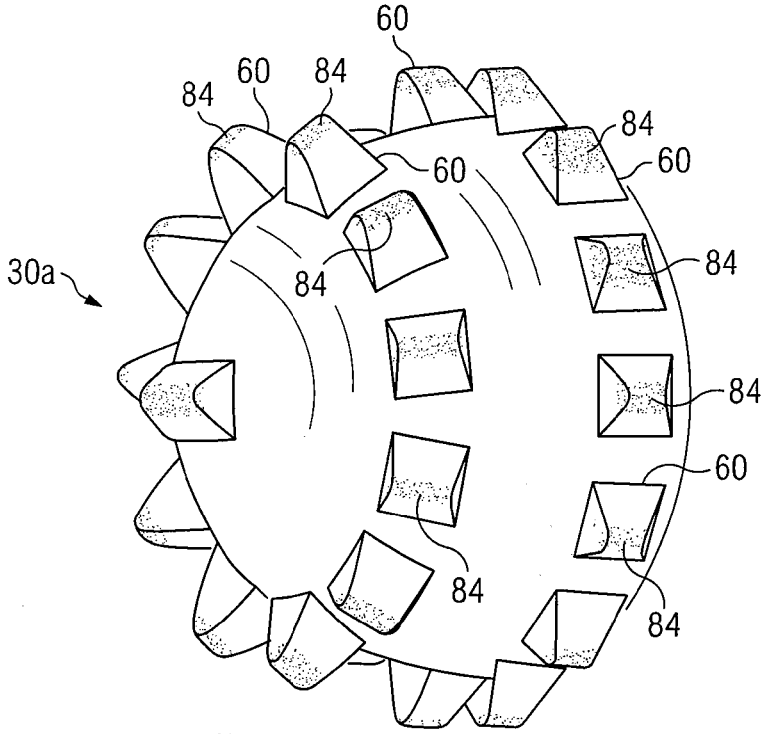
FIG. 15A is a schematic drawing showing an isometric view of respective cutting zones for inserts associated with a first roller cone on a drill bit incorporating teachings of the present invention.
Figure 15B:
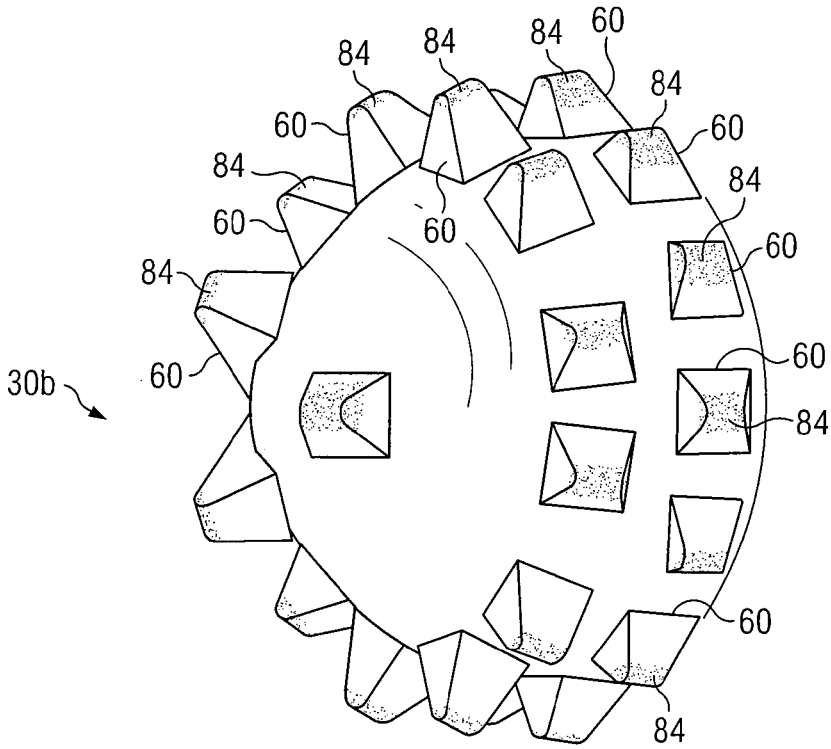
FIG. 15B is a schematic drawing showing an isometric view of respective cutting zones for inserts associated with a second roller cone of the drill bit incorporating teachings of the present invention.
Figure 15C:
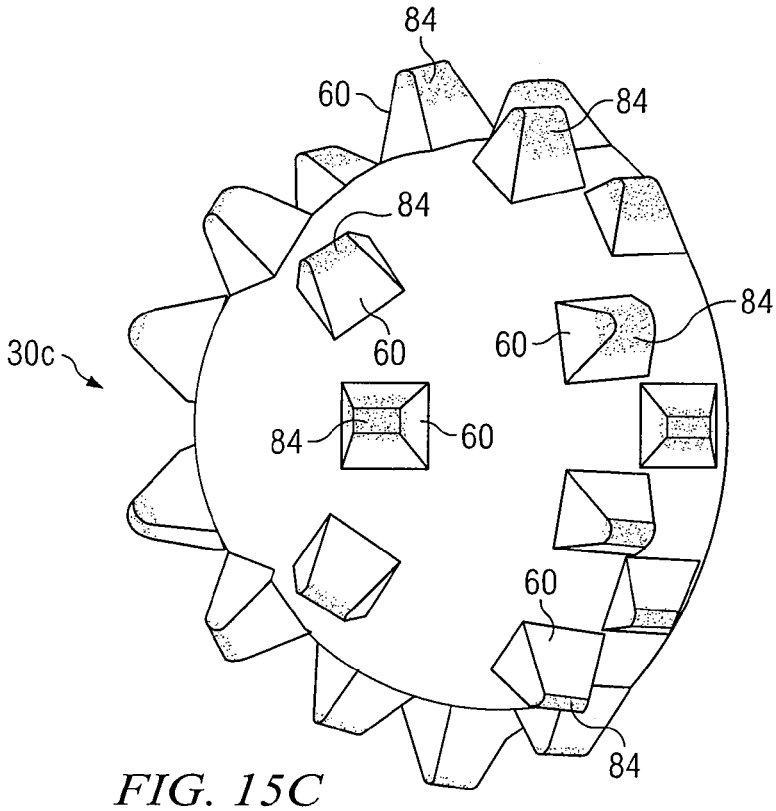
FIG. 15C is a schematic drawing showing an isometric view of respective cutting zones for inserts associated with a third roller cone of the drill bit incorporating teachings of the present invention.

FIGS. 15A, 15B and 15C may be schematic representations of roller cones 30*a*, 30*b* and 30*c*. Based on selected drill bit design parameters and selected drilling parameters, computer simulations incorporating teachings of the present invention may indicate the location of each cutting zone 84 on respective cutting element 60. Based upon the results of drilling simulations and comparing associated drilling performance, the design of cutting elements 60 and/or associated roller cones 30*a*, 30*b* and 30*c* may be modified to obtain optimum drilling performance from the associated roller cone drill bit 20. Similar calculations and determinations may be made to show the loading zone, wear zone and/or stress zone associated with each cutting element 60.

Figure 16A:
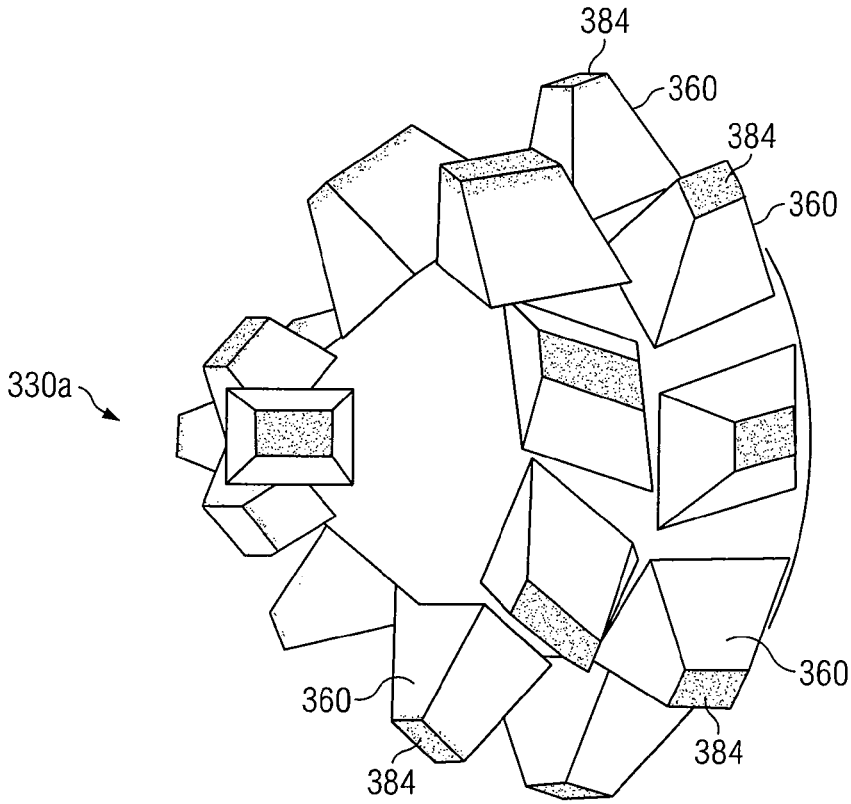
FIG. 16A is a schematic drawing showing an isometric view of respective cutting zones for milled teeth associated with a first roller cone of a drill bit incorporating teachings of the present invention.
Figure 16B:
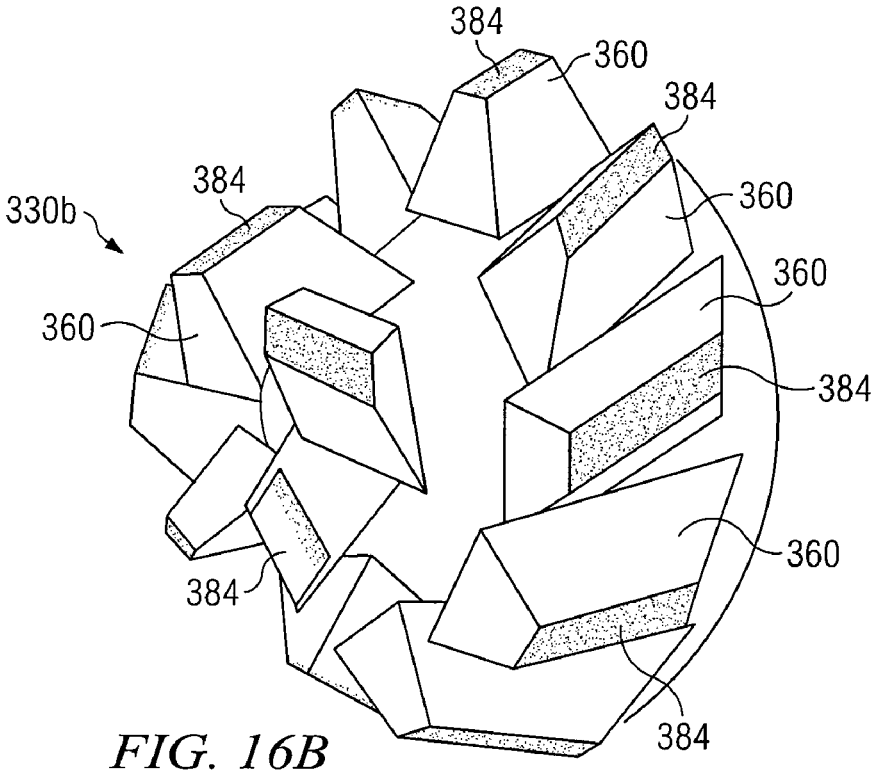
FIG. 16B is a schematic drawing showing an isometric view of respective cutting zones for milled teeth associated with a second roller cone of the drill bit incorporating teachings of the present invention.
Figure 16C:
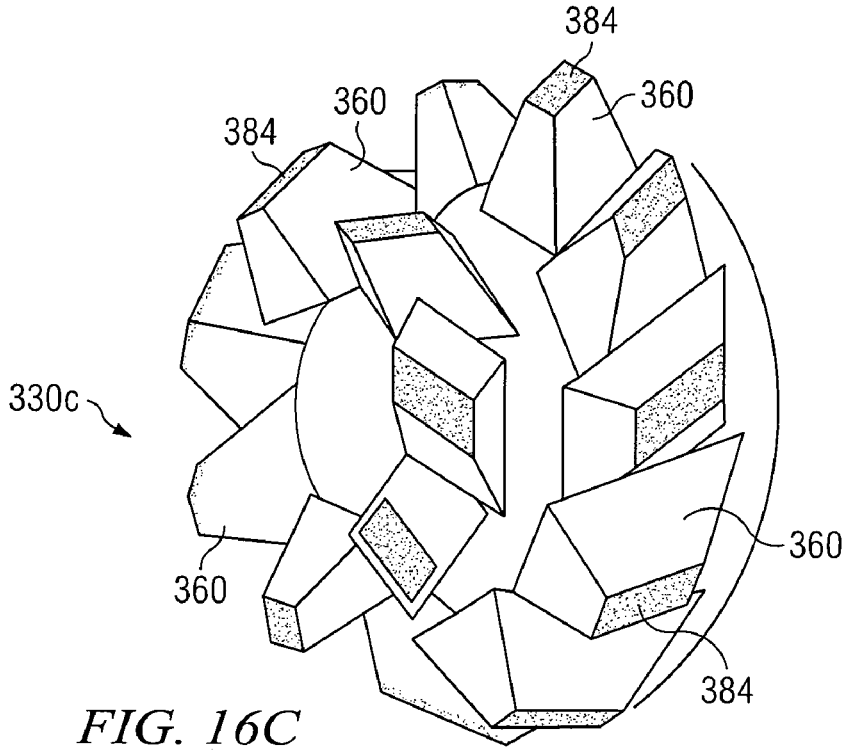
FIG. 16C is a schematic drawing showing an isometric view of respective cutting zones for milled teeth associated with a third roller cone of the drill bit incorporating teachings of the present invention.

FIGS. 16A, 16B and 16C may be schematic representations of cone assemblies 330*a*, 330*b* and 330*c*. Each cone assembly 330*a*, 330*b* and 330*c* includes a plurality of milled tooth cutting elements 360 disposed within respective rows on the exterior thereof. Computer modeling and computer simulation techniques incorporating teachings of the present invention may be used to determine respective cutting zone 384 on each cutting element 360. As shown in FIGS. 16A, 16B and 16C cutting zones 384 on each cutting element 360 may have a different configuration and location. The orientation, spacing and size of each cutting zone 384 may be selected to optimize one or more drilling performance criteria in accordance with teachings of the present invention. One or more layers of hardfacing material (not expressly shown) may also be deposited on each cutting zone 384 to minimize undesired wear of associated milled tooth 360. The location size and configuration of each layer of hardfacing material may be determined in accordance with teachings of the present invention.

Figure 22:
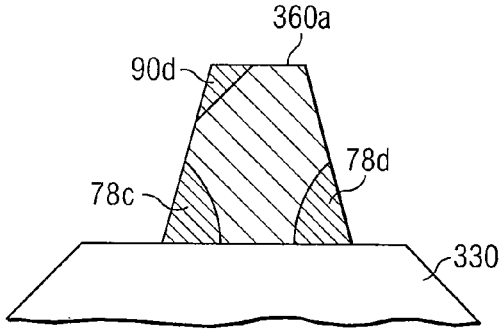
FIG. 22 is a schematic drawing in section with portions broken away showing a milled tooth type cutting element formed on a cone assembly and associated stress zones determined in accordance with the teachings of the present invention.
Figure 23:
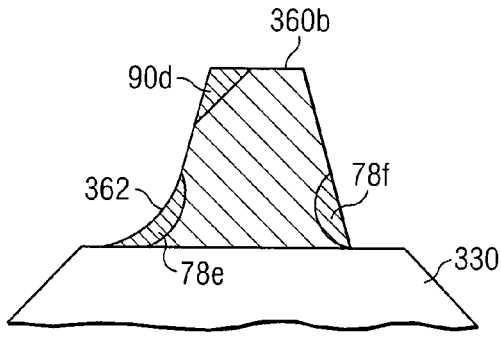
FIG. 23 is a schematic drawing in section with portions broken away showing modifications made to the configuration of the milled tooth type cutting element of FIG. 22 in accordance with the teachings of the present invention.

After the cutting zone and loading zone (force profile over the cutting zone) have been determined for each cutting element of an associated roller cone drill bit, finite element analysis may be performed to determine the stress distribution over each cutting element. The amount or value of stress associated with each mesh segment may then be calculated and respective stress zones for each cutting element may be determined. As shown in FIGS. 22 and 23 stress zones are often located differently from an associated cutting zone or loading zone. The location of each stress zone depends on various drill bit design parameters including, but not limited to, the location of an associated loading zone and associated cutting element geometry.

The failure mode of a cutting element or cutting structure generally depends on the stress level acting on each cutting element or cutting structure. Two general types of stresses which may result in failure of cutting elements and cutting structures include residual stress created during manufacture of a cutting element or cutting structure and applied stress created during downhole drilling.

Milled teeth which are generally formed (milled) as integral components of an associated roller cone will typically have residual stress only when hardfacing materials are applied to exterior portions of each milled tooth. Failure modes for milled teeth primarily result from wear and breakage associated with applied stress during downhole drilling.

Inserts and compacts which are generally formed as individual components by compressing and/or sintering hard materials typically have residual stress from the associated manufacturing process. Inserts associated with roller cone drill bits may be divided into three groups-tungsten carbide inserts (TCI), diamond enhanced inserts (DEI) and composite inserts (CI).

Examples of diamond enhanced inserts and composite inserts are shown in U.S. Pat. No. 6,105,694 entitled "Diamond Enhanced Insert for Rolling Cutter Bit", U.S. Pat. No. 6,241,035 entitled "Superhard Enhanced Inserts for Earth-Boring Bits", U.S. Pat. No. 6,394,202 entitled "Drill Bit Having Diamond Impregnated Inserts Primary Cutting Structure" and U.S. Pat. No. 6,725,953 entitled "Drill Bit Having Diamond Impregnated Inserts Primary Cutting Structure". U.S. Pat. No. 5,722,497 entitled "Roller Cone Gage Surface Cutting Elements With Multiple Hard Cutting Surfaces" and U.S. Pat. No. 5,755,298 entitled "Hardfacing With Coated Diamond Particles" also show additional hard materials which may be satisfactorily used to form cutting elements and cutting structures in accordance with teachings of the present invention.

Residual stress is often much lower than applied stress in a typical tungsten carbide insert. Residual stress may be much higher than applied stress in a typical diamond enhanced insert. Residual stress of diamond enhanced inserts may be significantly reduced by designing the interface between each diamond layer and associated tungsten carbide matrix in accordance with teachings of the present invention. Residual stress associated with manufacture of composite inserts may also be reduced by designing composite inserts in accordance with teachings of the present invention.

One of the failure modes associated with both inserts and milled teeth is fatigue induced cracking. This type of failure or crack may often be initiated in the highest stress portion of each stress zone. As the number of contacts or impacts increases between a cutting element and adjacent portions of a formation, any surface cracks on the respective cutting element may progressively propagate into additional segments of the cutting element. Propagation of a fatigue induced crack may continue until the length of the crack is sufficient to allow a portion of the cutting element to chip or may completely break the associated cutting element. Determining the location of cutting zones and stress zones on each cutting element of a roller cone drill bit may be used to predict chipping or breakage of each cutting element from fatigue induced cracks. The present invention allows determining with relatively high probability the initial location of fatigue induced cracks and the downhole drilling life or time before chipping and/or breakage of the respective cutting element may occur.

Cutting element wear may be directly related to forces or stresses acting on respective cutting elements, sliding velocity of each cutting element, respective temperature of each cutting element and the amount of time each cutting element is exposed to the high temperature and forces or stresses. Cutting elements associated with roller cones drill bits generally experience substantially different wear patterns as compared with cutting elements associated with fixed cutter or PDC drill bits.

In fixed cutter drill bits the associated cutting elements are almost always in constant contact with the downhole formation. As a result, wear of cutting elements associated with fixed cutter drill bits may generally be directly proportional to drilling time. However, cutting elements associated with roller cone drill bits typically contact adjacent portions of a bottom hole formation for only relatively short time periods during each revolution of the associated drill bit. The temperature of each cutting element increases substantially during the respective contact time period. After each cutting element disengages from the downhole formation, the temperature generated during the contact period will generally be significantly reduced by drilling fluid flow. See nozzles 26 in FIG. 1. Therefore, it is generally more difficult to estimate temperature generated by cutting elements of a roller cone drill bit during short time periods of contact with an adjacent formation.

Cutting element wear may be predicted using the following general formula: $w=(k)\times(f)\times(v)\times(t)$.

"w" is the wear height. "k" corresponds with a constant associated with respective materials used to form each cutting element. "f" is the force acting on each cutting element. "v" is the sliding velocity of the cutting element. "t" corresponds with contact time between the cutting element and the adjacent formation.

Contact time t may be determined by calculating the distance or trajectory of each cutting element over a portion of the bottom hole and the sliding velocity. Meshing cutting elements in accordance with teachings of the present invention and calculating the cutting zone, loading zone, stress zone and wear zones may result in better estimation of contact time and associated temperature as each cutting element of a roller cone drill bit engages adjacent portions of a formation.

Figure 17:
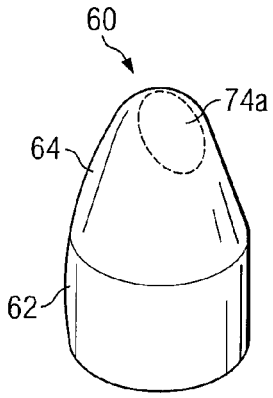
FIG. 17 is a schematic drawing showing an isometric view of an insert and an associated location and size for a cutting zone, loading zone and/or wear zone determined in accordance with teachings of the present invention.

FIGS. 17-23 show examples of how computer simulation of interaction between a roller cone drill bit and adjacent portions of a bottom hole formation may be used to modify or change the design of a cutting element. The same techniques and procedures may also be used to modify the design of a cone assembly and/or a roller cone drill bit. FIG. 17 is a schematic drawing showing cutting element or insert 60 defined in part by cylindrical body 62 and extension 64.

Interaction between cutting element 60 and an associated roller cone drill bit with adjacent portions of bottom hole 212 may indicate area 74*a* corresponding with an associated core cutting zone, core loading zone and/or core stress zone depending on the type of computer simulation and associated calculations. For some applications hard materials may be disposed in a cutting element at a respective wear zone in accordance with teachings of the present invention. See FIGS. 18, 20, 21A and 21B. The resulting cutting elements may sometimes be described as "composite inserts". Hard materials may also be disposed on exterior portions of a cutting element at a respective wear zone in accordance with teachings of the present invention.

Figure 18:
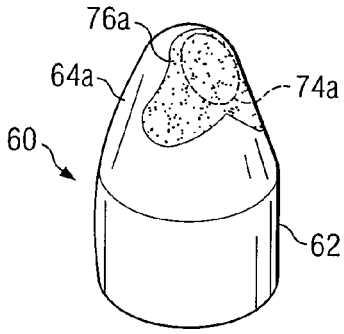
FIG. 18 is a schematic drawing shown an isometric view of a layer of hard material disposed on the insert of FIG. 17 based on analysis of the associated cutting zone, loading zone and/or wear zone in accordance with teachings of the present invention.

Based on the location and size of each area 74*a*, various changes in the design and/or configuration of cutting element 60 may be conducted to determine which design changes optimize performance of the associated roller cone drill bit. For some applications the design analysis and comparison such as stress zones and/or wear zones may indicate that a relatively large segment of material with increased hardness should be inserted or disposed within extension 64. The resulting cutting element 60*a* is shown in FIG. 18 with insert 76*a* formed from very hard material disposed within extension 64*a*. The location, size and orientation of hard material insert 76*a* may be selected based on drilling simulations conducted in accordance with teachings of the present invention. For this embodiment hard material insert 76*a* may be larger than area 74*a*.

Figure 19:
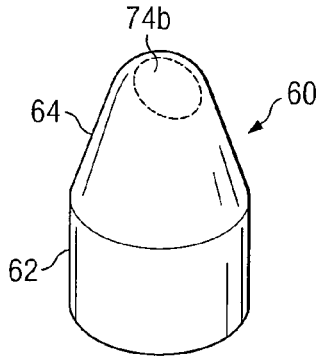
FIG. 19 is a schematic drawing showing an isometric view of an insert and an associated location and size for a cutting zone, loading zone and/or wear zone determined in accordance with teachings of the present invention.
Figure 20:
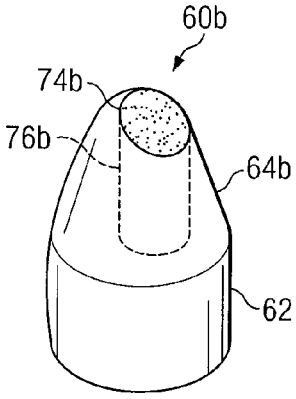
FIG. 20 is a schematic drawing showing an isometric view of a composite insert having a pillar or post of hard material based on analysis of the associated cutting zone, loading zone and/or wear zone of the insert in FIG. 19 in accordance with teachings of the present invention.

As previously noted, the location of a cutting element on a roller cone assembly may change the location of an associated cutting zone, loading zone, stress zone and/or wear zone for the same drill bit design and the same drilling parameters. FIG. 19 shows that when cutting element 60 is placed in a different location on an associated roller cone assembly, area 74*b* will change as compared with the location and size of area 74*a*. A series of drilling simulations in accordance with teachings of the present invention may indicate that insert 76*b* formed from relatively hard material disposed within extension 64*b* will optimize drilling performance of the associated drill bit design. For this embodiment composite insert 76*b* may have the general configuration of a cylindrical post with an end surface corresponding with the exterior configuration of extension 64*b*.

Figure 21A:
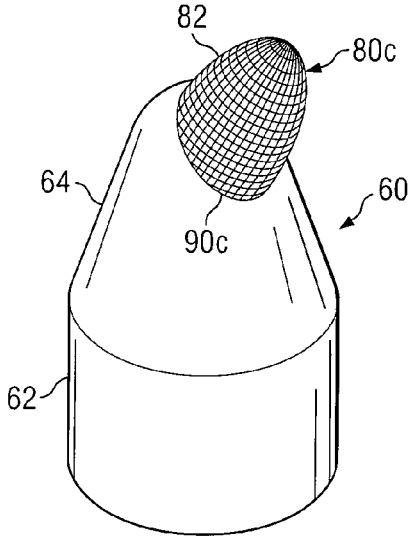
FIG. 21A is a schematic drawing showing an isometric view of an insert with a core loading zone and three dimensional force profile determined in accordance with teachings of the present invention.
Figure 21B:
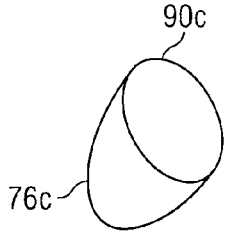
FIG. 21B is a schematic drawing showing an isometric view of hard materials which may be disposed within the insert of FIG. 21A to form a composite insert in accordance with teachings of the present invention.

FIG. 21A is a schematic drawing showing cutting element or insert 60. Computer simulations of interactions between cutting element 60 and an associated roller cone drill bit with adjacent portions of bottom hole 212 may be used to determine core loading zone 90*c* and an associated three dimensional force profile represented by mesh 80*c* in accordance with teaching of the present invention. Based on the configuration and size of three dimensional force profile 80*c*, hard material insert 76*c* may be designed with a corresponding complimentary or mirror image size and configuration. The configuration and size of hard material insert 76*c* may be generally symmetrical with three dimensional force profile 80*c*. See FIG. 21B.

Hard material insert 76*c* may be disposed in extension 64 of cone 60 opposite from three dimensional force profile 80*c* associated with core loading zone 90*c*. The perimeter of core loading zone 90*c* generally corresponds with the perimeter of mesh 80*c* at the intersection with extension 64 of insert 60. The perimeter of core loading zone 90*c* also generally corresponds with the perimeter of hard material insert 76*c* proximate the exterior of extension 64.

FIG. 22 is a schematic drawing showing cutting element or milled tooth 360*a* disposed on an exterior portion of cone assembly 330. Computer simulations of interactions between milled tooth 360*a* and an associated roller cone drill bit with adjacent portions of bottom hole 212 may be used to determine associated core loading zone 90*d* and core stress zones 78*c* and 78*d*. Based on the results of the computer simulations, the design of milled tooth 360*a* may be modified to form milled tooth 360*b* as shown in FIG. 23 by forming radius portion 362 extending between the exterior of cone assembly 330 and milled tooth 360*b*. The size and location of radius portion 362 may be modified based on computer simulations incorporating teachings of the present invention to optimize downhole drilling performance of the resulting cutting element or milled tooth 360*b* and associated roller cone drill bit. For example with the same core loading zone 90*d*, core stress zones 78*e* and 78*f* may be substantially reduced as compared with core stress zones 78*c* and 78*d* of milled tooth 360*a*.

Figure 24:
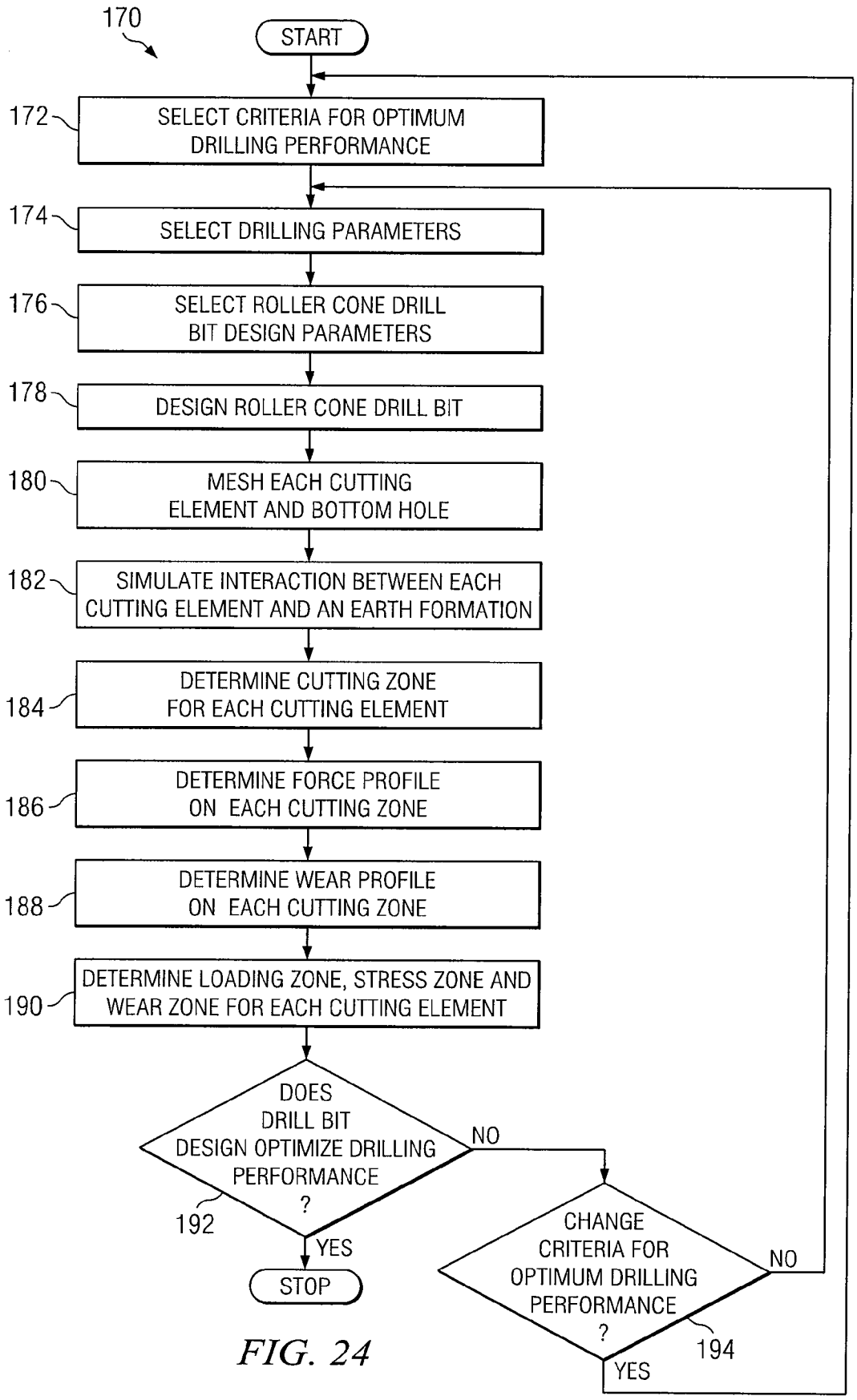
FIG. 24 is a block diagram showing one example of a method for designing a roller cone drill bit in accordance with teachings of the present invention.

FIG. 24 is a block diagram showing various steps associated with one method of designing a roller cone drill bit with cutting elements and cutting structures incorporating teachings of the present invention. Method 170 may begin at step 172 by selecting one or more criteria for optimum drilling performance of a resulting roller cone drill bit design. One of the criteria for optimum drilling performance may be the simulated penetration rate of the bit or the simulated bit drilling life. Various drilling parameters may be selected at step 174. Various roller cone drill bit design parameters such as identified by Independent Association of Drilling Contractors (IADC) codes and as discussed in this application may be selected at step 176.

An initial design for a roller cone drill bit may then be made at step 178. Various components including cutting elements, roller cone assemblies and the roller cone drill bit may be placed in cutting element, roller cone and bit coordinate systems as part of the design process. At step 180, each cutting element may be meshed and portions of a bottom hole or earth formation may also be meshed. Simulated drilling of the roller cone drill bit and a selected earth formation may be conducted at step 182.

At step 184 respective cutting zones on each cutting element and respective core cutting zones may be determined based on the number of contacts between the mesh segments of each cutting element and mesh segments of the earth formation. At step 186 a force profile or force distribution may be determined over each cutting zone. At step 188 a wear profile may be determined over each cutting zone. At step 190 each loading zone, stress zone and wear zone may be determined for each cutting element.

The results of the simulation may be evaluated at step 192 to determine if the initial drill bit design optimizes drilling performance based on the criteria selected at step 172. If the answer is no, a change may be made to the optimum drilling performance criteria or steps 174 through 190 may be repeated until a subsequent drill bit design provides optimum drilling performance at which time the method ends.

Although the present invention and its advantages have been described in detail, it should be understood that various changes, substitutions and alternations can be made herein without departing from the spirit and scope of the invention as defined by the following claims.

What is claimed is:

1. A roller cone drill bit comprising:

a bit body having at least one support arm extending therefrom;

a respective cone assembly rotatably mounted on each support arm for engagement with a subterranean formation to form a wellbore;

each cone assembly having a respective axis of rotation extending from the associated support arm;

each cone assembly having at least two rows of cutting elements;

each cutting element including a hardfacing material having a thickness, the thickness and a location of the hardfacing material on each respective cutting element designed based on a stress zone and a wear zone determined by simulated interaction of the respective cutting element and portions of the subterranean formation; and each cutting element designed with a respective cutting zone and a respective loading zone at optimum locations for the respective cutting element based on the location of the respective cutting element on the respective cone assembly and simulated interaction of the respective cutting element and portions of the subterranean formation.

2. The drill bit of claim 1 wherein the cutting elements comprise a plurality of inserts attached to the cone assemblies.

3. The drill bit of claim 1 wherein the cutting elements comprises a plurality of milled teeth formed as part of the cone assemblies.

4. A roller cone drill bit comprising:

a bit body having three support arms extending therefrom;

a respective cone assembly rotatably mounted on each support arm for drilling engagement with a subterranean formation to form a wellbore;

each cone assembly having respective rows of cutting elements;

each cutting element including a hardfacing material having a thickness, the thickness and a location of the hardfacing material on each respective cutting element designed based on a stress zone and a wear zone determined by simulated interaction of the respective cutting element and portions of the subterranean formation; and each cutting element designed with a respective cutting zone and a respective loading zone at optimum locations on the respective cutting element based on the location of the respective row of the cutting element and simulated interaction of the drill bit and respective cutting element with portions of the subterranean formation.

5. The drill bit of claim 4 wherein the cutting elements comprise a plurality of inserts attached to the cone assemblies.

6. The drill bit of claim 4 wherein the cutting elements comprises a plurality of milled teeth formed as part of the cone assemblies.

7. The drill bit of claim 4 wherein each cutting element comprises a respective wear zone to optimize drilling life of the drill bit.

8. The drill bit of claim 4 wherein each cutting element comprises a respective stress zone to optimize drilling life of the drill bit.

9. The drill bit of claim 4 further comprising the respective cutting zone of each cutting element designed to optimize rate of penetration of the drill bit through the subterranean formation.

10. The drill bit of claim 4 further comprising the respective loading zone of each cutting element designed to optimize rate of penetration of the drill bit through the subterranean formation.

11. The drill bit of claim 4 further comprising the respective cutting zone of each cutting element designed to optimize force balance of the drill bit as it proceeds through the subterranean formation.

12. The drill bit of claim 4 further comprising the respective loading zone of each cutting element designed to optimize force balance of the drill bit as it proceeds through the subterranean formation.

13. The drill bit of claim 4 further comprising the respective cutting zone of each cutting element designed to optimize work balance of the drill bit as it proceeds through the subterranean formation.

14. The drill bit of claim 4 further comprising the respective loading zone of each cutting element designed to optimize work balance of the drill bit as it proceeds through the subterranean formation.

15. A roller cone drill bit comprising:

a bit body having at least one support arm extending therefrom;

a respective cone assembly rotatably mounted on each support arm for engagement with a subterranean formation to form a wellbore;

each cone assembly having a respective axis of rotation extending from the associated support arm;

each cone assembly having at least two rows of cutting elements;

each cutting element including a hardfacing material having a thickness, the thickness and a location of the hardfacing material on each respective cutting element designed based on a stress zone and a wear zone determined by simulated interaction of the respective cutting element and portions of the subterranean formation; and each cutting element designed with a respective cutting zone and a respective loading zone at optimum locations for the respective cutting element based at least in part on the respective row of the cutting element.

16. The drill bit of claim 15 wherein the simulated interaction of the respective cutting element and portions of the subterranean formation includes using a three dimensional mesh representation of each cutting element.

17. The drill bit of claim 15 wherein each cutting element comprises a respective wear zone to optimize drilling life of the bit.

18. The drill bit of claim 15 wherein each cutting element comprises a respective stress zone to optimize drilling life of the drill bit.

19. The drill bit of claim 15 further comprising the respective cutting zone of each cutting element designed to optimize rate of penetration of the drill bit through the subterranean formation.

20. The drill bit of claim 15 further comprising the respective loading zone of each cutting element designed to optimize rate of penetration of the drill bit through the subterranean formation.

* * * * *